US007661987B2

(12) United States Patent
Adachi et al.

(10) Patent No.: US 7,661,987 B2
(45) **Date of Patent: *Feb. 16, 2010**

(54) CONNECTOR WITH SMALL CAVITY ARRANGED AT LEAST PARTLY BETWEEN TWO LARGE CAVITIES

(75) Inventors: Hideo Adachi, Yokkaichi (JP); Hiroyoshi Maesoba, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/353,316

(22) Filed: Jan. 14, 2009

(65) Prior Publication Data

US 2009/0186512 A1 Jul. 23, 2009

(30) Foreign Application Priority Data

Jan. 17, 2008 (JP) ..... 2008-008092

(51) Int. Cl.
*H01R 13/40* (2006.01)

(52) U.S. Cl. ..... 439/595; 439/752; 439/679; 439/924.1

(58) Field of Classification Search ..... 439/610, 439/350, 595, 752, 579, 679, 924.1, 101, 439/106, 677
See application file for complete search history.

(56) References Cited

U.S. PATENT DOCUMENTS

| | | | | |
|---|---|---|---|---|
| 2,993,189 | A * | 7/1961 | Schelke et al. | 439/136 |
| 4,232,930 | A | 11/1980 | Teti | |
| 5,458,496 | A * | 10/1995 | Itou et al. | 439/34 |
| 6,099,352 | A | 8/2000 | Yamaguchi | |
| 6,171,150 | B1 | 1/2001 | Saito et al. | |
| 2007/0054543 | A1 | 3/2007 | Moll et al. | |
| 2008/0026639 | A1 | 1/2008 | Sardi et al. | |

FOREIGN PATENT DOCUMENTS

DE 29706324 1/1998

* cited by examiner

*Primary Examiner*—Javaid Nasri
(74) *Attorney, Agent, or Firm*—Gerald E. Hespos; Anthony J. Casella

(57) ABSTRACT

A connector (10) is provided with substantially round large terminals (12) connected with ends of shielded wires (SW), a small terminal (13) connected with an end of an insulated wire (W) and a housing (11) in which two large cavities (27) for receiving the large terminals (12) are arranged side by side and a small cavity (28) for receiving the small terminal (13) is arranged at a position between the two large-size cavities (27) and displaced from the both large cavities (27) in a direction orthogonal to an arrangement direction of the large cavities (27).

15 Claims, 30 Drawing Sheets

CONNECTOR WITH SMALL CAVITY ARRANGED AT LEAST PARTLY BETWEEN TWO LARGE CAVITIES

BACKGROUND OF THE INVENTION

1. Field of the Invention

The invention relates to a connector in which large and small terminal fittings are mounted in a single housing.

2. Description of the Related Art

U.S. Pat. No. 6,171,150 and FIG. 34 herein disclose a connector with a housing 1. Two large cavities 2 and one small cavity 3 are formed in the housing 1. Large terminal fittings connected with ends of shielded wires and a small terminal fitting connected with an end of an insulated wire can be inserted respectively into the large and small cavities 2 and 3. The large-size and small-size cavities 2, 3 are arranged in a line along the width direction in the housing 1. Thus, the connector is enlarged in the width direction.

The present invention was developed in view of the above situation, and an object thereof is to promote miniaturization.

SUMMARY OF THE INVENTION

The invention relates to a connector with a housing. The housing has at least two first cavities for receiving first terminals connected with ends of wires and at least one second cavity for receiving a second terminal connected with an end of a wire. The second terminal is smaller than the first terminals. The first cavities are arranged substantially side by side. The second cavity is at a position aligned with a space between the first cavities, but is displaced from the first cavities in a direction orthogonal to an arrangement direction of the first cavities.

The first terminals preferably have a substantially round or polygonal shape and the respective first cavities substantially conform to the outer shapes of the first terminals.

A space between the first cavities preferably is wider at positions more distant from the centers of the first cavities in the direction substantially orthogonal to the arrangement direction since both large cavities have the substantially round or polygonal cross-sectional shape. The second cavity utilizes this space. Thus, the housing can be miniaturized in the arrangement direction of the first cavities as compared with the case where the cavities are arranged in a line.

First terminal locking lances preferably are provided at sides of the inner surfaces of the large first cavities substantially toward the small second cavity for resiliently engaging and retaining the inserted first terminals. A part of the small second cavity is arranged between the two large first terminal locking lances. With this construction, part of the small cavity is arranged utilizing the space between the two large terminal locking lances to help achieve miniaturization even if the small second cavity cannot be accommodated completely in the space between the adjacent two large cavities.

At least one second terminal locking lance preferably is provided at a side of the inner surface of the second cavity toward the first cavities for engaging and retaining the inserted second terminal. A deformation space is arranged at least partly between the two first cavities for permitting a resilient deformation of the second terminal locking lance. With this construction, the deformation space for the small terminal locking lance utilizes the space between the two large cavities to help achieve miniaturization.

The connector may further include a retainer for retaining the respective terminals in the housing. The retainer preferably is inserted into the housing in a direction intersecting axial directions of the respective The first terminal locks enter the first cavities to engage the first terminals and the second terminal lock enters the second cavity to engage the second terminal. The first terminal locks and the second terminal lock preferably are displaced in the axial directions of the respective cavities. Front ends of the first terminal locks and the second terminal lock with respect to a mounting direction of the retainer into the housing preferably are connected to each other by at least one reinforcement. With this construction, the retainer has sufficient strength.

First cavity peripheral walls preferably surround the first cavities and a second cavity peripheral wall preferably surrounds the second cavity. The first and second cavity peripheral walls preferably are connected with each other. At least one cutout preferably is formed in parts of the first cavity peripheral walls substantially opposite to the second cavity. The cutout is at ends where the wires are drawn out for permitting the wires to be bent. Thus, the wires connected with the large terminals can be bent without interfering with the large cavity peripheral walls. On the other hand, the parts of the large cavity peripheral walls connected to the small cavity peripheral wall remain to provide sufficient strength for the housing.

Each wire connected with the first terminal preferably is a shielded wire with an outer conductor arranged concentrically outside an inner conductor. Each first terminal preferably includes an outer conductor connecting portion to be connected with the outer conductor of the shielded wire. A ground terminal preferably is mountable to the housing and includes terminal contact pieces that can be brought into electrical contact with the outer conductor connecting portions. Terminal contact piece insertion grooves preferably are formed in parts of the first cavity peripheral walls substantially opposite the second cavity for permitting entry of the terminal contact pieces into the first cavities. With this construction, the shielded wires can be bent and can escape into the cutout. As a result, the shielded wires are not likely to bite in the edges of the terminal contact piece insertion grooves.

At least one stabilizer insertion groove preferably is formed in each first cavity at the sides of the first terminal locking lance for receiving at least one stabilizer of the first terminal.

The second cavity preferably overlaps the stabilizer insertion grooves of the adjacent first cavities in the displacement direction.

The sum of the width of the first terminal locking lance and the widths of both stabilizer insertion grooves preferably is less than the diameter of the first cavity.

At least one bracket mounting portion may be arranged on the housing so that a bracket fixed to an outside body can be mounted thereto.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with a first embodiment of the invention is described with reference to FIGS. 1 to 25 and is identified generally by the numeral 10. The connector 10 is a male connector to be mounted on a bracket B to be fixed to a body (not shown) e.g. of an automotive vehicle. In the following description, reference is made to FIGS. 6 and 9 concerning a vertical direction VD (height direction).

Figure 8:
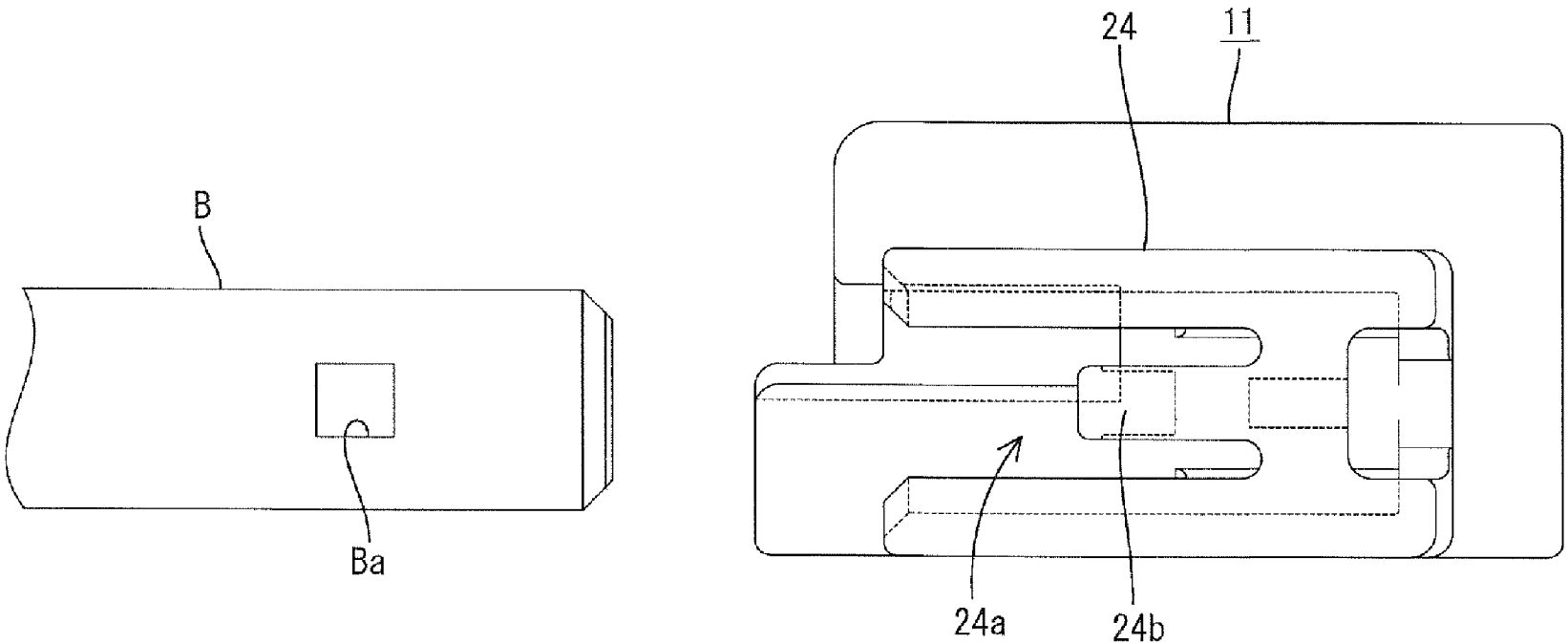
FIG. 8 is a side view of a bracket and the housing.

FIG. 8 illustrates the bracket B on which the connector 10 is to be mounted. The bracket B is made of an electrically conductive material, such as metal, and defines a wide plate extending from a position fixed to the body. A lock hole Ba penetrates a widthwise middle position of the bracket B near the leading end. The leading end of the bracket B is beveled or thinned over the entire periphery to enable the connector 10 to be mounted smoothly.

Figure 9:
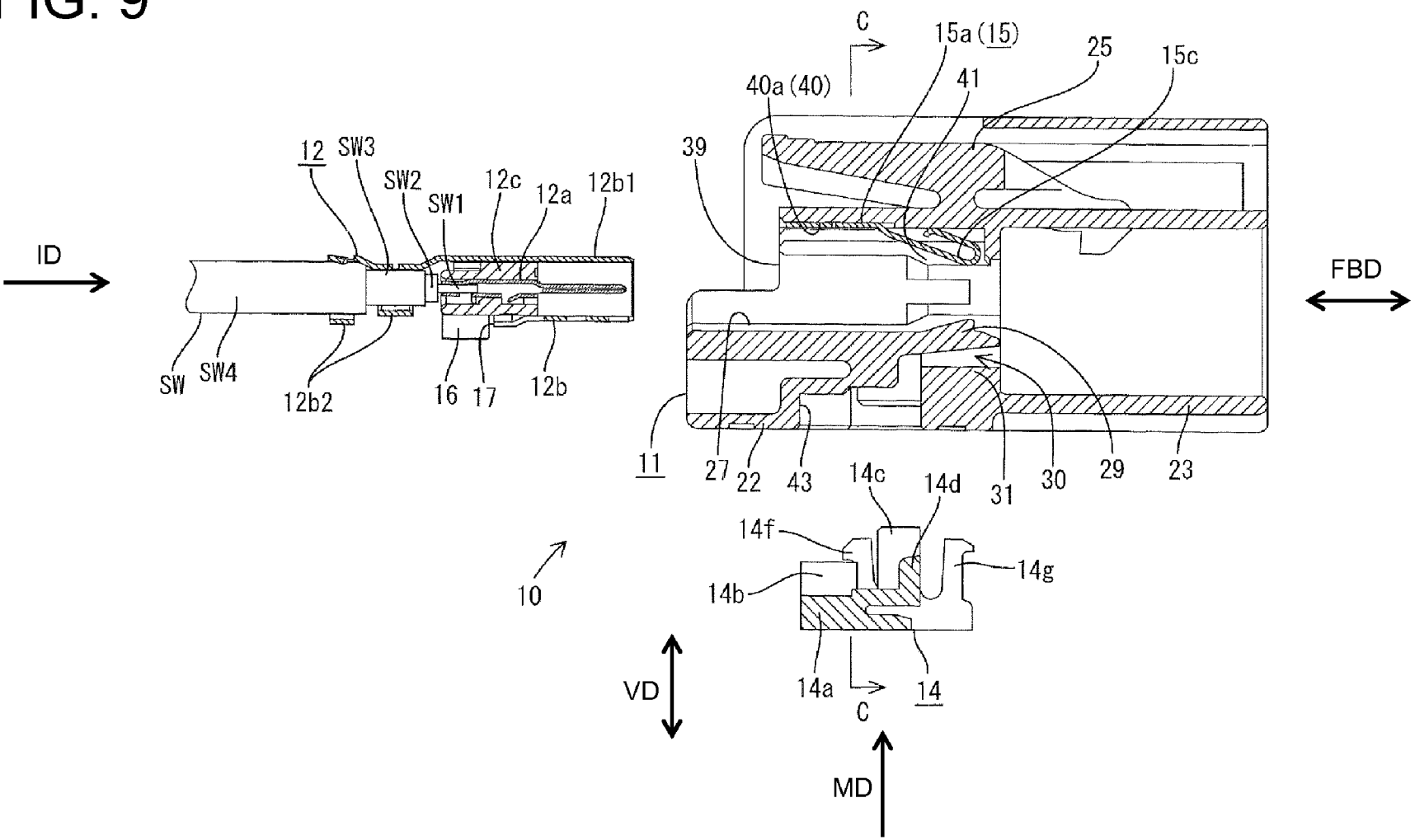
FIG. 9 is a section along A-A of FIG. 7 showing the housing, the large-size terminal and a retainer.
Figure 10:
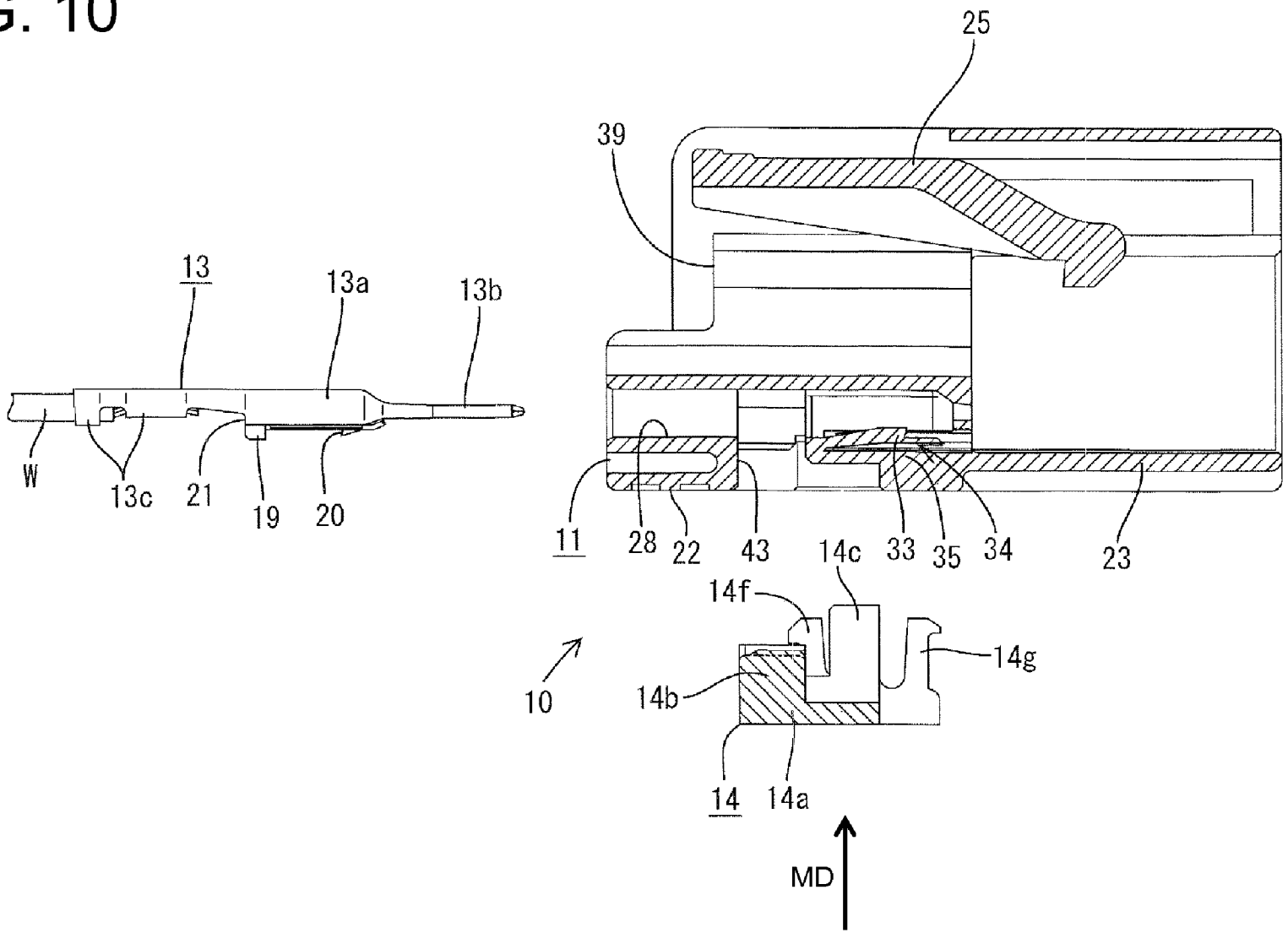
FIG. 10 is a section along B-B of FIG. 7 showing the housing, the large-size terminal and the retainer.
Figure 11:
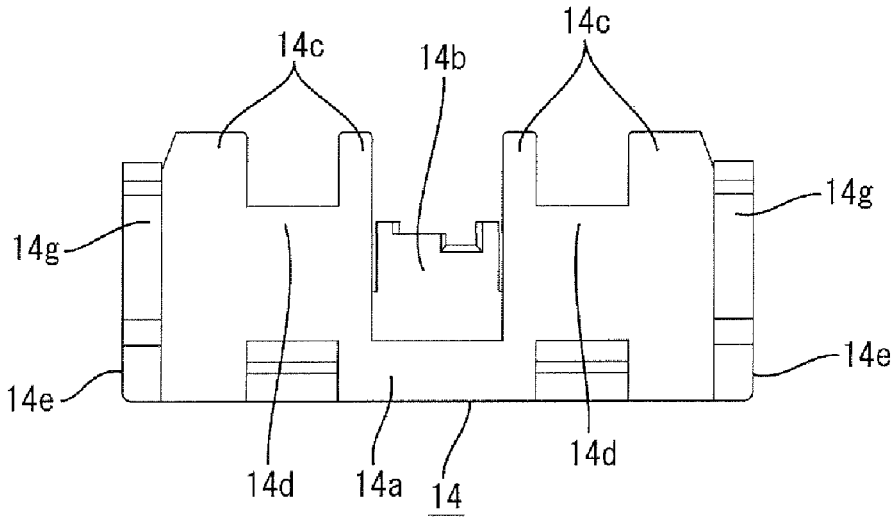
FIG. 11 is a front view of the retainer.
Figure 12:
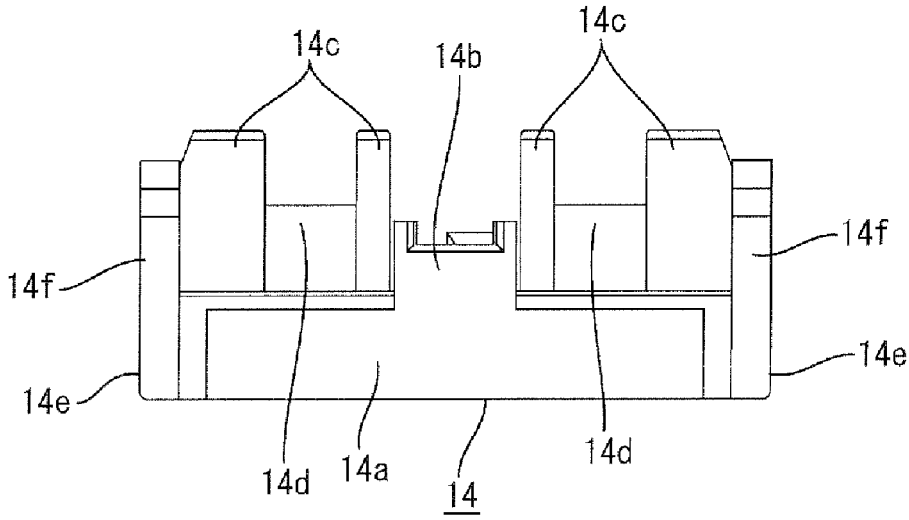
FIG. 12 is a rear view of the retainer.
Figure 13:
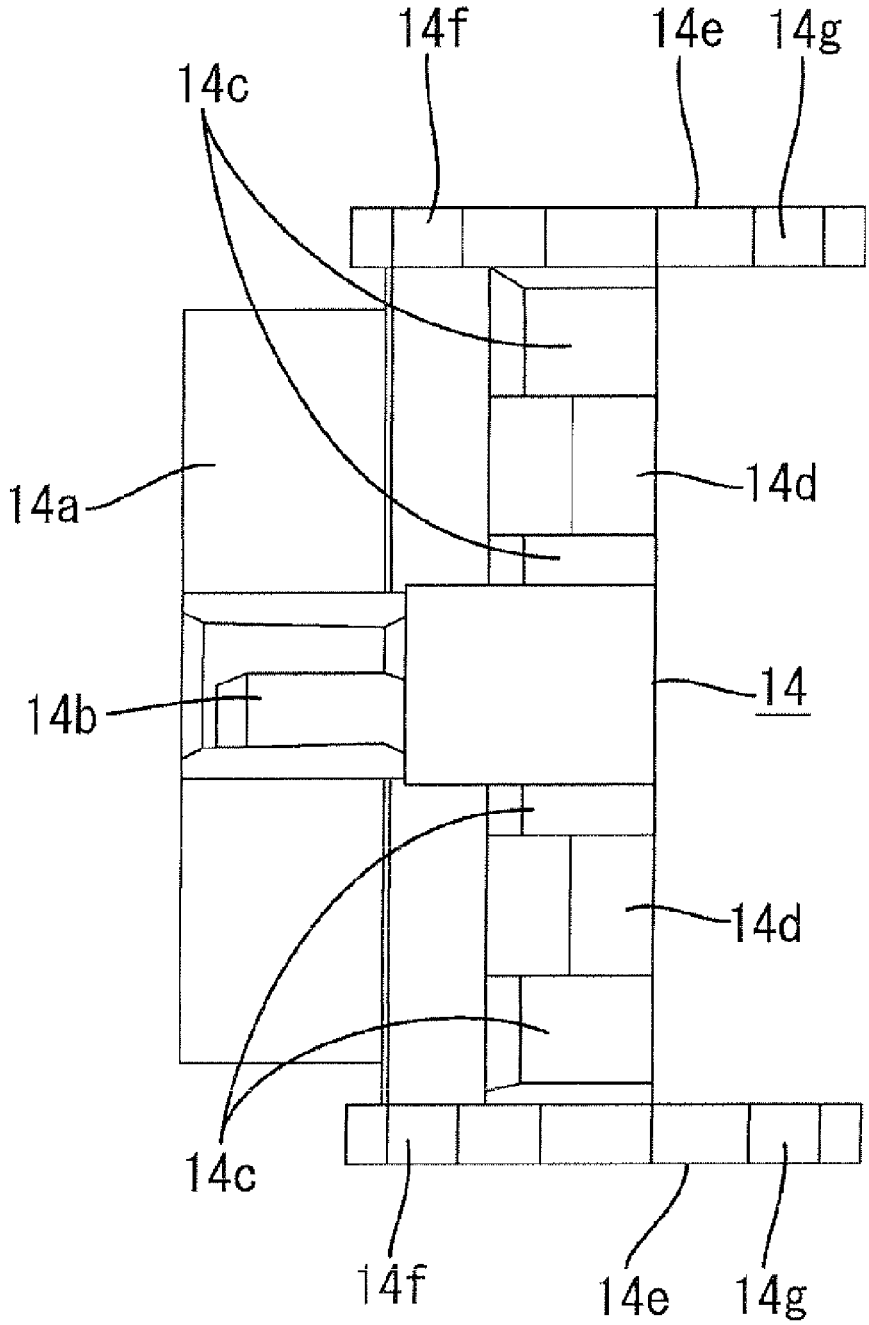
FIG. 13 is a plan view of the retainer.

As shown in FIGS. 9 and 10, the connector 10 has a housing 11, large male terminals 12 connected with ends of shielded wires SW, a small male terminal 13 connected with an end of an insulated wire W, a retainer 14 for retaining the terminals 12, 13 and a ground terminal 15 for electrically connecting parts of the large terminals 12 and the bracket B. The small terminal 13 has a smaller outer shape than the large terminals 12. In the following description, an inserting direction ID of the respective terminals 12, 13 into the housing 11 and an opposite pull-out direction of the respective wires SW, W are referred to as forward direction and a backward directions FBD.

Figure 1:
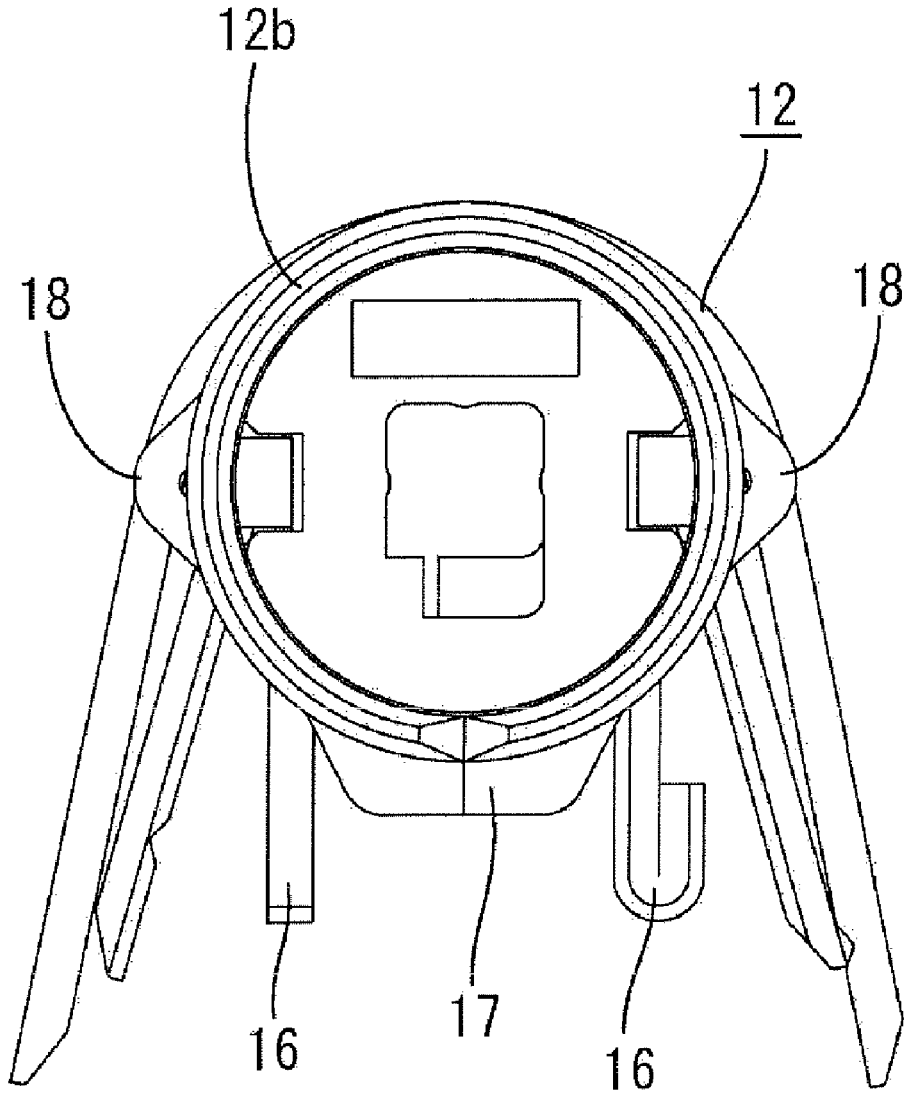
FIG. 1 is a front view of a large-size terminal according to a first embodiment of the invention.

Each shielded wire SW connected with the large terminal 12 has an inner conductor SW1, an inner insulation layer SW2, an outer conductor SW3 and an outer sheath SW4 arranged substantially concentrically in this order from an axial center. The inner conductor SW1 or core is a signal wire of an electric circuit of the automotive vehicle. The outer conductor SW3 may be a braided wire or film-like conductor and constitutes a ground wire of the electric circuit. As shown in FIG. 1, the large terminal 12 has a substantially circular shape when viewed from the front and is made of an electrically conductive material, such as metal. As shown in FIG. 9, the large terminal 12 includes an inner conductor connecting portion 12*a* to be connected with the inner conductor SW1 of the shielded wire SW, an outer conductor connecting portion 12*b* arranged outside the inner conductor connecting portion 12*a* and to be connected with the outer conductor SW3, and an insulator 12*c* between the inner conductor connecting portion 12*a* and the outer conductor connecting portion 12*b* for keeping insulation therebetween. A substantially cylindrical main portion 12*b*1 forms an outermost part of the outer conductor connecting portion 12*b* and surrounds the inner conductor connecting portion 12*a* over substantially the entire periphery. A wire connecting portion 12*b*2 is rearward of the main portion 12*b*1 and is crimped, bent or folded into connection with the outer conductor SW3 exposed at the end of the shielded wire SW.

Two stabilizers 16 are formed to open up the main portion 12*b*1 at a side substantially opposite to a bottom plate that is continuous with the main portion 12*b*1 and the wire connecting portion 12*b*2 at the rear end of the main portion 12*b*1. The stabilizers 16 are plates that face each other at the opposite sides of the open part at the rear end of the main portion 12*b*1 and extend substantially down in a vertical direction VD. Retainer engaging surfaces are defined at the rear ends of the stabilizers 16. A lance engaging portion 17 is provided at the front edge of the open part in the main portion 12*b*1. This lance engaging portion 17 is worked to project down and substantially radially out from the main portion 12*b*1. The main portion 12*b*1 is cut at two positions spaced approximately 90° from the lance engaging portion 17, and the cut portions are bent out to define two projections 18. The wire connecting portion 12*b*2 includes front and rear pairs of crimping pieces. The inner conductor connecting portion 12*a* includes a tab projecting from the insulator 12*c* into the main portion 12*b*1 of the outer conductor connecting portion 12*b*. The tab can be brought into electrical contact with a large terminal of an unillustrated female connector to be connected with the connector 10.

Figure 2:
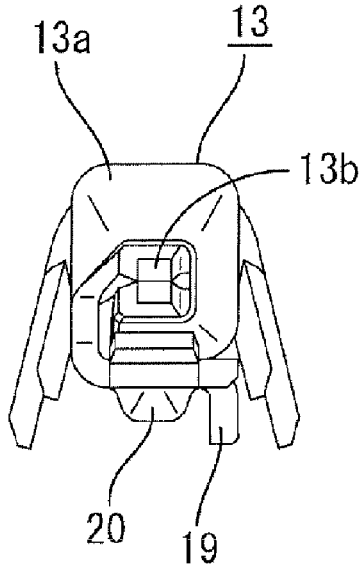
FIG. 2 is a front view of a small-size terminal.

The insulated wire W to be connected with the small terminal 14 has a structure of covering a core with an insulation coating. As shown in FIG. 2, the small-size terminal 13 has a vertically long rectangular shape when viewed from the front and is made of an electrically conductive material such as metal. The small terminal 13 includes a rectangular tubular main portion 13*a* that is long and narrow in forward and backward directions FBD. A tab 13*b* extends forward from the main portion 13*a* and a wire connecting portion 13*c* extend backward from the main portion 13*a*, as shown in FIG. 10.

A stabilizer 19 is provided at the rear end of an outer wall of the main portion 13*a* at a side substantially opposite to a bottom plate that is continuous with the wire connecting portion 13*c*. The stabilizer 19 is a plate that projects out and down from the end of the outer wall in substantially the same direction as the stabilizers 16 of the large terminal 12. A lance engaging portion 20 is provided at the outer wall formed that has the stabilizer 19. The lance engaging portion 20 is formed by working the front edge of a cutout in a substantially in a middle part of the outer wall to project out and down in substantially the same direction as the lance engaging portion 17 of the large terminal 12. A step-shaped retainer engaging portion 21 is provided at the rear end of the outer wall of the main portion 13*a* at a position substantially opposite to the bottom wall. The wire connecting portion 13*c* includes front and rear pairs of crimping pieces. Further, the tab 13*b* can be brought into electrical contact with a small terminal of the unillustrated female connector.

Figure 3:
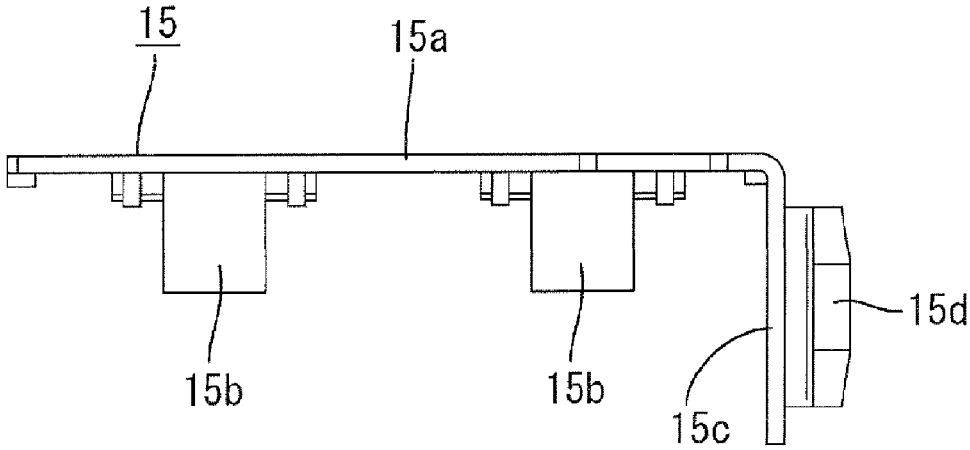
FIG. 3 is a rear view of a ground terminal.
Figure 4:
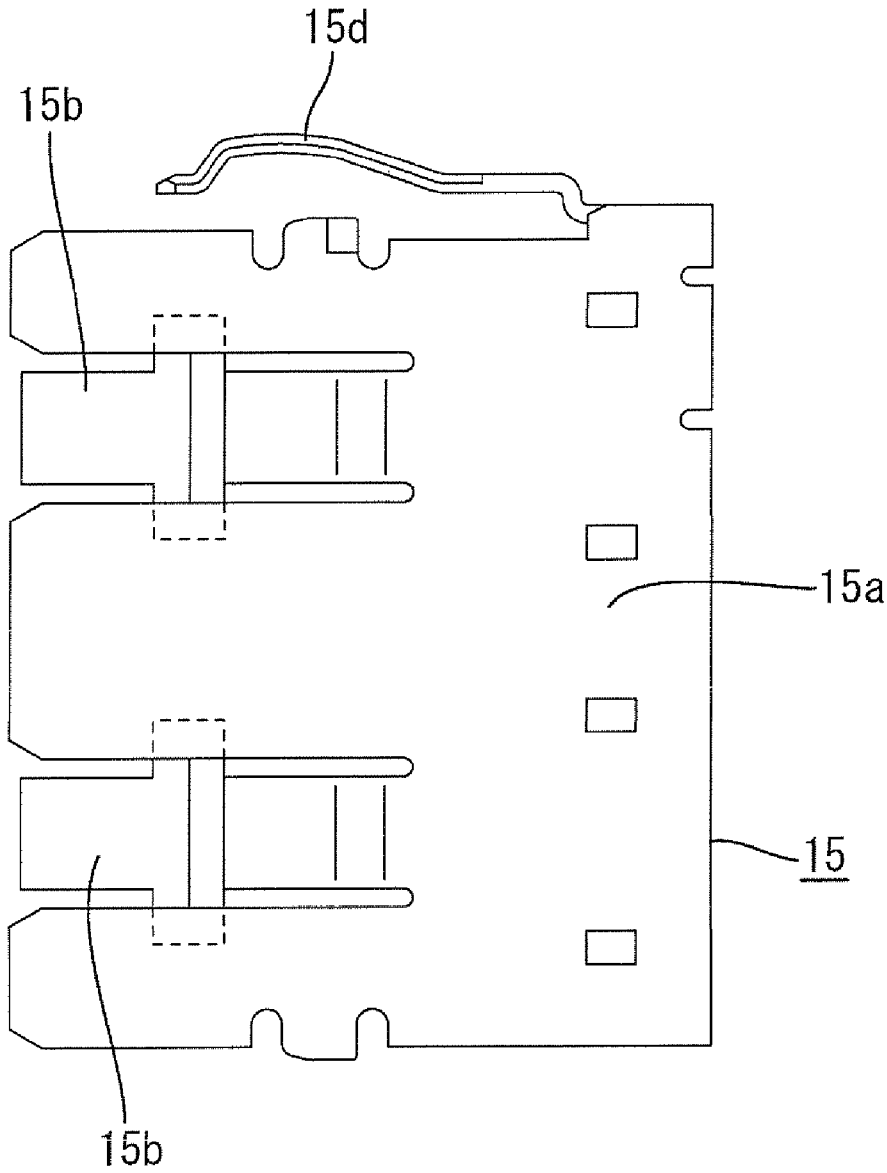
FIG. 4 is a plan view of the ground terminal.
Figure 5:
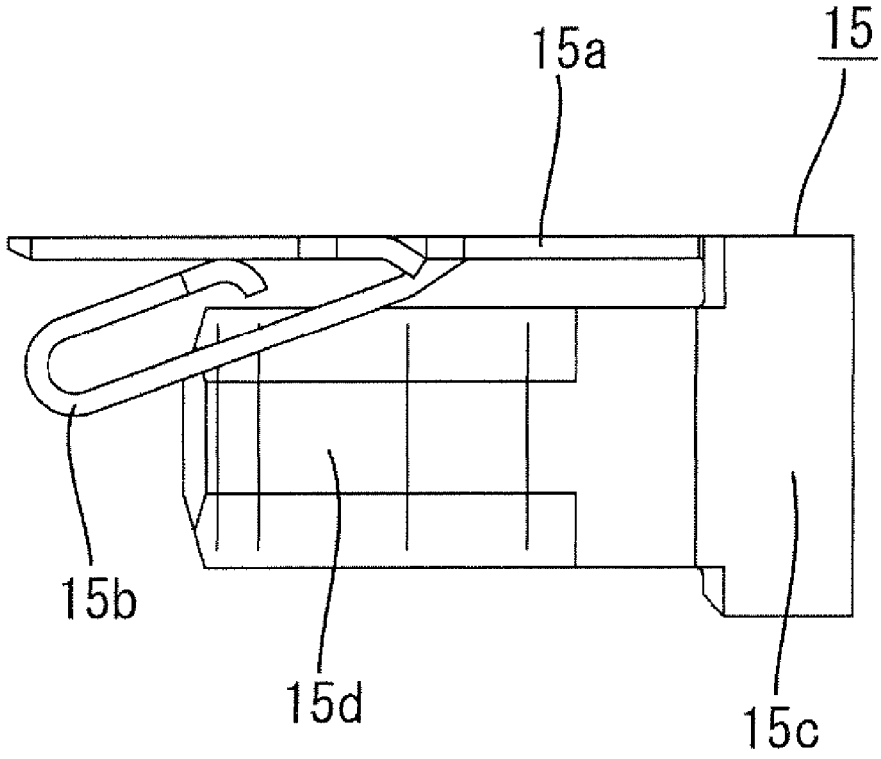
FIG. 5 is a side view of the ground terminal.

The ground terminal 15 is made of an electrically conductive material, such as metal, and includes a substantially horizontal base plate 15*a*. Two terminal contact pieces 15*b* are formed by cutting and bending parts of the base plate 15*a*. A side plate 15*c* is bent substantially perpendicularly down from a lateral edge of the base plate 15*a* and extends substantially in the vertical direction VD. At least one bracket contact piece 15*d* extends from the side plate 15*c*, as shown in FIGS. 3 to 5. The terminal contact pieces 15*b* can achieve electrical contact the inner conductor terminals 12*b* of the corresponding large terminals 12 and the bracket contact piece 15*d* can be brought into electrical contact with the bracket B. The base plate 15*a* and the side plate 15*c* form a substantially L shape when viewed from front.

The base plate 15*a* is substantially rectangular in a plan view and a central part of the base plate 15*a* is cut and bent to form a retaining piece that is engageable with the housing 11. Each terminal contact piece 15*b* is cantilevered forward between two forwardly open slits in the base plate 15*a* and extends forward beyond the slits. As shown in FIG. 5, the terminal contact piece 15*b* is bent from the base plate 15*a* to project obliquely down in substantially the same direction as the side plate 15*c* and then is folded toward the base plate 15*a* at the front end of the base plate 15*a*. The fold of the terminal contact piece 15*b* defines a contact point with the large terminal 12. The terminal contact piece 15*b* is resiliently deformable up and down in directions substantially orthogonal to an inserting direction ID of the large terminal 12 with the base end as a support point. The side plate 15*c* is formed by bending a piece projecting from the rear lateral edge of the base plate 15*a* substantially at right angles. The bracket contact piece 15*d* also is cantilevered forward and has a free front end that is resiliently deformable in a width direction WD and substantially orthogonal to an inserting direction ID of the bracket B with the base end as a support. The bracket contact piece 15*d* has a substantially moderate mountain shape that projects from the side plate 15*c* toward a side opposite to the base plate 15*a* and has a peak at an intermediate position. The peak of the bracket contact piece 15*d* defines a contact.

Figure 6:
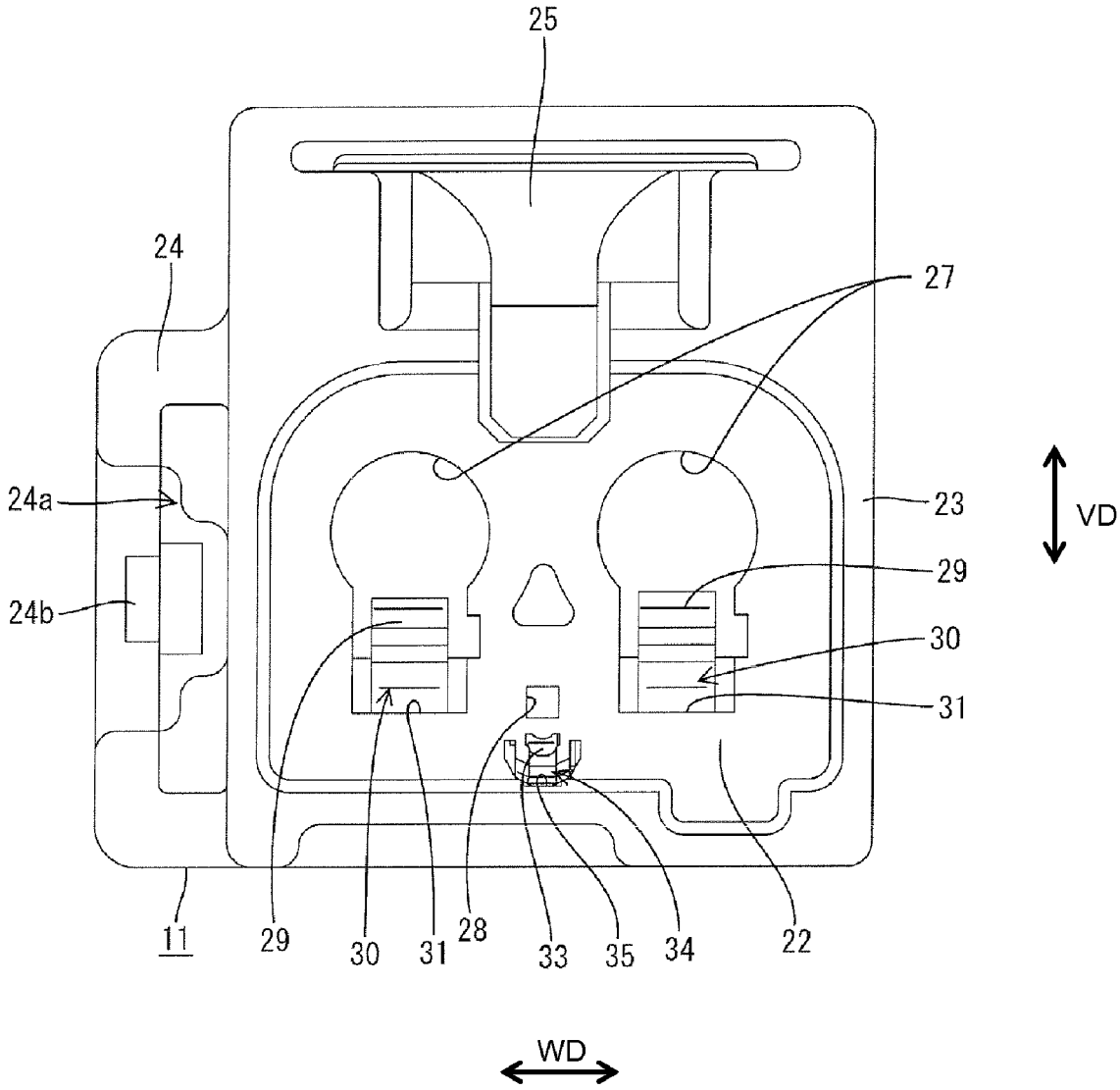
FIG. 6 is a front view of a housing.
Figure 7:
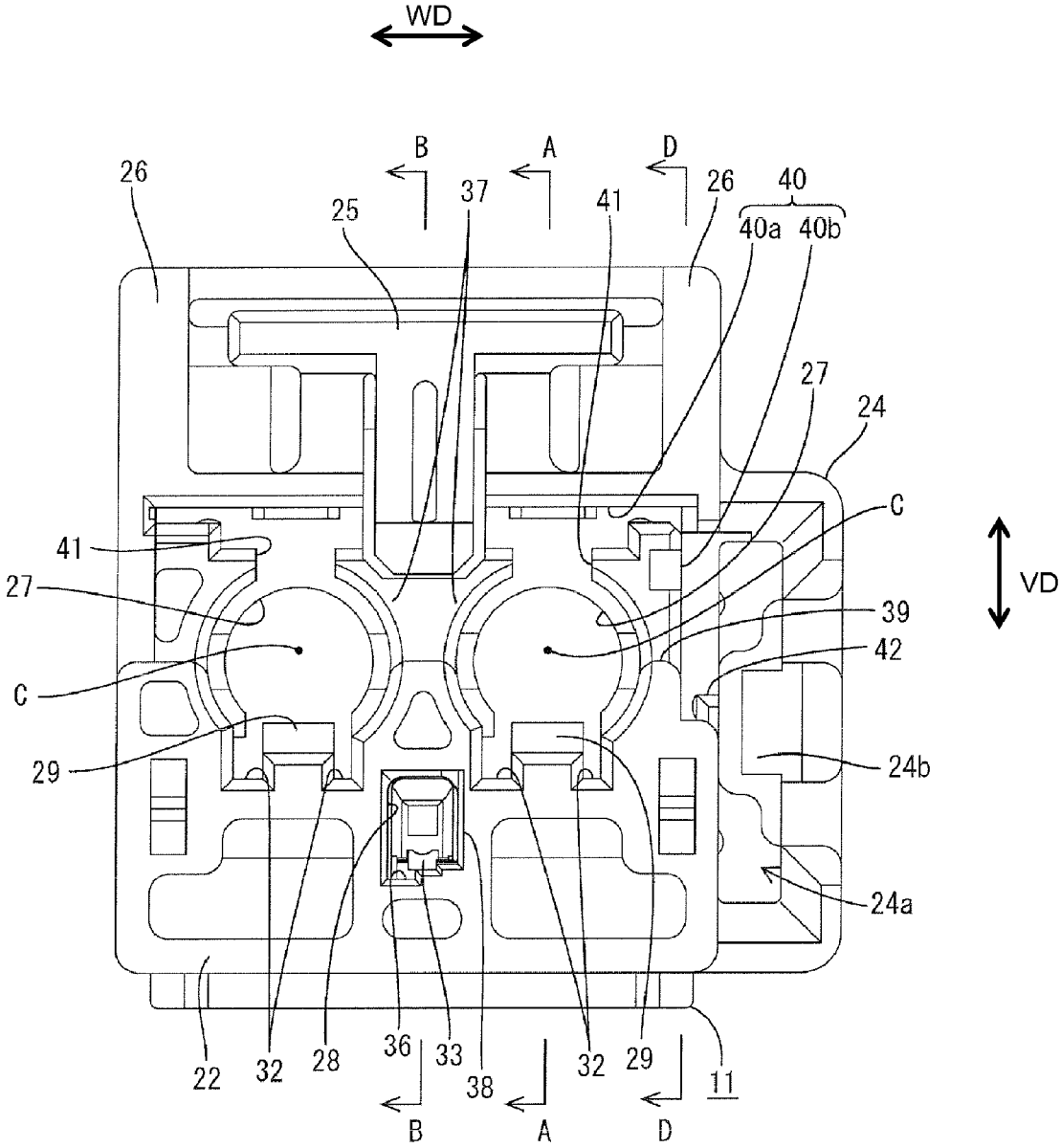
FIG. 7 is a rear view of the housing.

The housing 11 is made e.g. of a synthetic resin and has a terminal accommodating portion 22 for accommodating the terminals 12, 13 and the ground terminal 15, a receptacle 23 for receiving the unillustrated mating female connector and a bracket mounting portion 24 to which the bracket B is mounted, as shown in FIGS. 6 and 7. The receptacle 23 is a forwardly open substantially rectangular tube that projects forward from the terminal accommodating portion 22. A connection space is defined in or by the receptacle 23 for receiving the mating female connector from the front. A lock arm 25 and two lock protectors 26 are provided on the upper surfaces of the terminal accommodating portion 22 and the receptacle 23. The lock arm holds the female connector in a connected state and the lock protectors 26 face each other at opposite sides of the lock arm 25 to protect the lock arm 25.

The terminal accommodating portion 22 is substantially in the form of a block with at least two large cavities 27 for accommodating the large terminals 12 and at least one small cavity 28 for accommodating the small terminal 13. The cavities 27, 28 penetrate the terminal accommodating portion 22 in forward and backward directions FBD, and the corresponding terminals 12, 13 are inserted therein from behind and along the inserting direction. Each large cavity 27 preferably has a substantially round cross section that conforms to the outer shape of the large terminal 12, whereas the small cavity 28 has a substantially vertically long rectangular cross section that conforms to the outer shape of the small terminal 13. The dimensions of the small cavity 28 are smaller than the corresponding dimensions of the large cavities 27.

The two large cavities 27 are formed side by side in the width direction WD in an upper level of the terminal accommodating portion 22. A space between the two large cavities 27 arranged in the width direction WD is narrowest at a position substantially corresponding to central positions C of the large cavities 27 and is wider toward upper and lower sides from this central position because both large cavities 27 have a substantially circular cross section. The small cavity utilizes an area of the space between the two large cavities 27 that is wider than an area corresponding to the central positions C. More specifically, the small cavity 28 is offset at a lower level of the terminal accommodating portion 22 and is aligned at a position between the two adjacent large cavities 27, but is displaced down in a direction substantially orthogonal to an arrangement direction WD of the large cavities 27, from the central positions C of the large cavities 27.

A large terminal locking lance 29 is cantilevered forwardly at a lower side of the inner surface of each large cavity 27 and toward the small cavity 28, as shown in FIG. 9. The large terminal locking lance 29 is substantially at a widthwise middle position of the front end of the lower part of the inner surface of the large cavity 27 and is configured to engage and retain the large terminal 12. The large terminal locking lance 29 is resiliently deformable down in the vertical direction VD, which intersects the inserting direction ID of the large terminal 12. A deformation space 30 is defined below the large terminal locking lance 29 in a resilient deforming direction for permitting resilient deformation of the large terminal locking lance 29. An excessive deformation preventing portion 31 is formed adjacent to and below the deformation space 30 for preventing deformation of the large terminal locking lance 29 beyond its resiliency limit. The large terminal locking lance 29 is narrower than the outer diameter of the large cavity 27. Two stabilizer insertion grooves 32 are formed at opposite sides of the large terminal locking lance 29 in the lower part of the inner surface of each large cavity 27, for receiving the stabilizers 16 of the large terminal 12. The stabilizer insertion grooves 32 are arranged substantially side by side in the width direction WD on opposite sides of the large terminal locking lance 29. The lower surface of the large terminal locking lance 29 is lower than the lower surfaces of the stabilizer insertion grooves 32, and the deformation space 30 and the excessive deformation preventing portion 31 are even lower. The sum of the width of the large terminal locking lance and the 29 stabilizer insertion grooves 32 is less than the outer diameter of the large cavity 27.

A small terminal locking lance 33 is formed by cutting off part of the lower side of the inner surface of the small cavity 28 at positions substantially opposite to the large cavities 27, as shown in FIG. 10. The small terminal locking lance 33 is supported at both ends and is resiliently deformable down in the vertical direction VD, which intersects an inserting direction ID of the small terminal 13. Thus, the small terminal locking lance 33 can engage and retain the small terminal 13 A deformation space 34 is defined below the small terminal locking lance 33 in a resiliently deforming direction for permitting a resilient deformation of the small terminal locking lance 33. An excessive deformation preventing portion 35 is formed below the deformation space 34 for engaging the small terminal locking lance 33 and preventing deformation of the small terminal locking lance 33 beyond its resiliency limit. The small terminal locking lance 33 is narrower than the outer diameter of the small cavity 28. A stabilizer insertion groove 36 is formed in the lower left corner of the inner surface of the small cavity 28 at one lateral side of the small terminal locking lance 33, as shown in FIG. 7. The stabilizer insertion groove 36 is configured to receive the stabilizer 19 of the small terminal 13.

The small cavity 28 partly overlaps the stabilizer insertion grooves 32 of the large cavities 27 in the vertical direction VD, as shown in FIGS. 6 and 7. Specifically, upper parts of the small cavity 28 align with bottom parts of the stabilizer insertion grooves 32 of the large-size cavities 27 in the width direction WD. Further, the small cavity 28 is between the stabilizer insertion grooves 32 of the large-size cavities 27 that are closer to the center of the terminal accommodating portion 22 and partly overlap inner lateral sides of the large cavities 27 in the width direction. In this way, the small cavity 28 partly overlaps the large cavities 27 in both the vertical direction VD and the width direction WD for contributing to miniaturization of the terminal accommodating portion 22. The small cavity 28 is disposed to avoid the central position where the space between the two large cavities 27 is narrowest. Further, a part of the small cavity 28 that projects down from the stabilizer insertion grooves 32 of the large cavities 27 is between the two large terminal locking lances 29 and the two deformation spaces 30 that are adjacent in the width direction WD and is in a positional relationship to overlap the two large terminal locking lances 29 and the two deformation spaces 30 in the vertical direction VD. In short, the small cavity 28 utilizes part of the space between the two large terminal locking lances 29 and the two deformation spaces 30 to achieve miniaturization.

The large and small cavities 27 and 28 are formed over the entire length of the terminal accommodating portion 22. Facing parts of large cavity peripheral walls 37 that enclose the large cavities 27 are connected with each other over substantially the entire length. Further, facing parts of the large cavity peripheral walls 37 and a small cavity peripheral wall 38 that surrounds the small cavity 28 also are connected with each other substantially over the entire length. As shown in FIGS. 7 and 9, a cutout 39 is formed in upper parts of the rear ends of the large cavity peripheral walls 37. The cutout 39 extends over substantially the entire width in an upper part of the terminal accommodating portion 22 including both large cavity peripheral walls 37. Substantially upper halves of both large cavity peripheral walls 37 are removed by the cutout 39 so that the shielded wires SW drawn out from the large cavities 27 easily can be bent substantially perpendicularly upward. On the other hand, lower portions of both large cavity peripheral walls 37 connected with the small cavity peripheral wall 38 remain to ensure sufficient strength for the thinner small cavity peripheral wall 38.

The bracket mounting portion 24 is arranged on a side surface of the housing 11 that extends substantially in the height direction, as shown in FIG. 8, and the bracket B can be mounted into the bracket mounting portion 24 so that the plate surface of the bracket B extends in the vertical direction VD. The bracket mounting portion 24 is an enclosure with a rearwardly open bracket accommodating chamber 24*a* that can receive the bracket B from behind. A bracket locking piece 24*b* is cantilevered in the bracket accommodating chamber 24*a* and can engage the lock hole Ba of the bracket B to retain the bracket B.

A rearwardly open ground terminal mounting groove 40 is formed in the terminal accommodating portion 22, as shown in FIG. 7, for receiving the ground terminal 15. The ground terminal mounting groove 40 is substantially L-shaped to conform to the outer shape of the ground terminal 15 when viewed from behind. More particularly, the ground terminal mounting groove 40 has a base plate accommodating part 40*a* extending in the width direction WD for receiving the base plate 15*a* and a side plate accommodating part 40*b* for receiving the side plate 15*c*. The base plate accommodating part 40*a* is arranged in the terminal accommodating portion 22 above the large cavities 27 and at a side opposite to the small cavity 28, while the side plate accommodating part 40*b* is between the right large cavity 27 shown in FIG. 7 and the bracket accommodating chamber 24*a*.

Two rearwardly open terminal contact piece insertion grooves 41 are formed in the large cavity peripheral walls 37 and extend between the base plate accommodating part 40*a* of the ground terminal mounting groove 40 and the two large cavities 27. The terminal contact piece insertion grooves 41 permit the entry of the terminal contact pieces 15*b* into the large cavities 27. The base plate accommodating part 40*a* and the terminal contact piece insertion grooves 41 are formed in substantially upper halves of the large cavity peripheral walls 37 where the cutout 39 is formed and face the large terminal locking lances 29. On the other hand, a rearwardly open bracket contact piece insertion groove 42 extends between the side plate accommodating part 40*b* of the ground terminal mounting groove 40 and the bracket accommodating chamber 24*a* and permits the entrance of the bracket contact piece 15*d* into the bracket accommodating chamber 24*a*.

Figure 17:
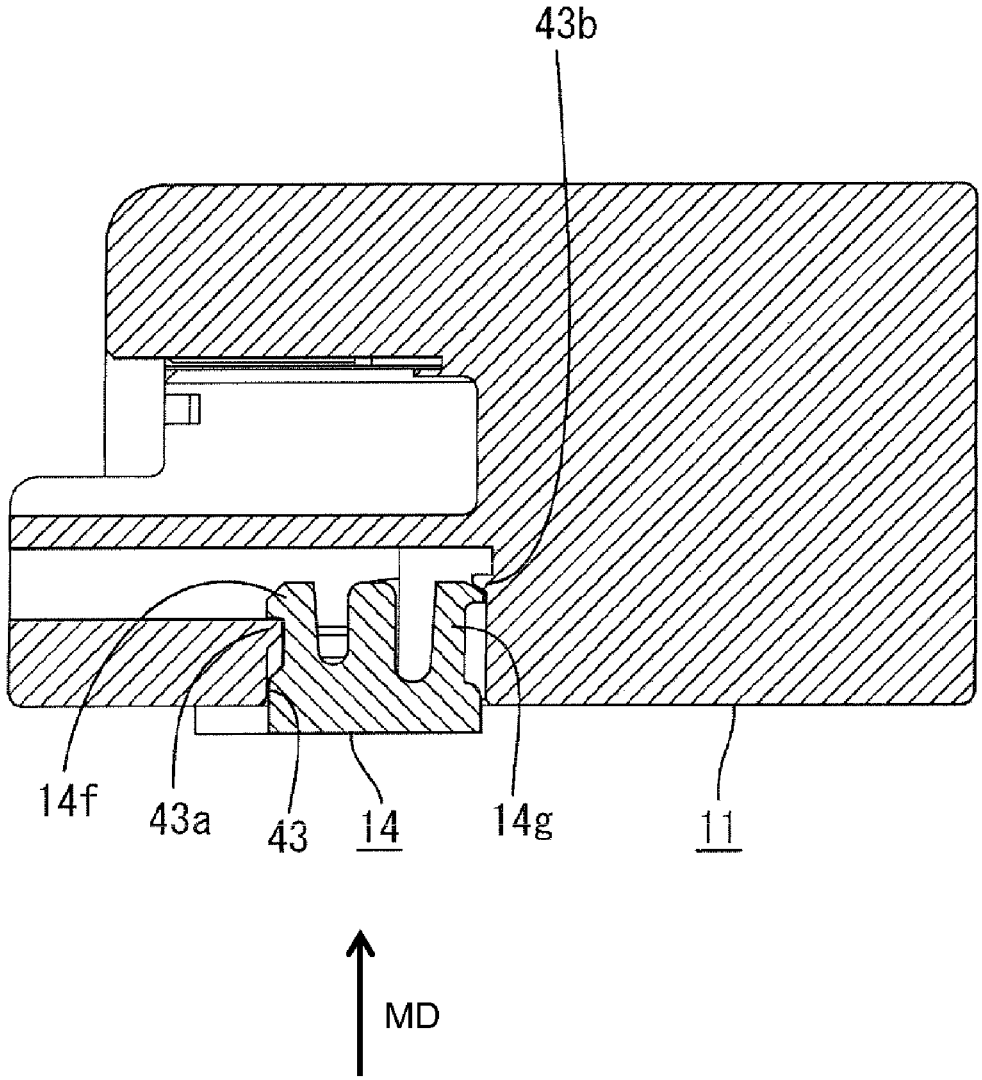
FIG. 17 is a section along D-D of FIG. 7 showing the state where the retainer is mounted at the partly locked position.

As shown in FIGS. 9, 10 and 17, a retainer mount hole 43 is formed in the lower side of the terminal accommodating portion 22 for receiving the retainer 14. The retainer mount hole 43 is formed by removing the lower parts of both large cavity peripheral walls 37 and the small cavity peripheral wall 38 of the terminal accommodating portion 22 and communicates with both large cavities 27 and the small cavity 28. The retainer mount hole 43 opens in the bottom surfaces of the respective cavities 27, 28 at positions behind the respective locking lances 29, 33.

The retainer mount hole 43 is formed in a range extending beyond the large cavities 27 in the width direction WD. First and second retainer holding portions 43*a* and 43*b* are provided at the opposite lateral sides of the retainer mount hole 43, as shown in FIG. 17, for holding the retainer 14. The first retainer holding portions 43*a* are near the rear edges of the lateral ends of the retainer mount hole 43, whereas the second retainer holding portions 43*b* are near the front edges of the lateral ends of the retainer mount hole 43 higher than the first retainer holding portions 43*a*.

The retainer 14 is made e.g. of a synthetic resin and includes a wide base 14*a*. A small terminal lock 14*b* projects up from a widthwise center of the base 14*a* near the back with respect to a mounting direction into the housing 11. Large terminal locks 14*c* project up at positions on the base 14*a* at opposite sides of the small terminal lock 14*b*, as shown in FIGS. 9 to 13.

The small terminal lock 14*b* can enter the small cavity 28 to engage the retainer engaging portion 21 of the small terminal 13 when the retainer 14 is mounted in the housing 11. On the other hand, the large terminal locks 14*c* can enter the stabilizer insertion grooves 32 of the corresponding large cavity 27 to engage the stabilizers 16 of the corresponding large terminal 12. Two large terminal locks 14*c* are arranged on the base 14*a* at positions corresponding to the stabilizers 16 of each large terminal 12 in the width direction WD. The large terminal locks 14*c* are vertically long plates and project up more than the small terminal lock 14*b*. The spacing between the large terminal locks 14*c* substantially coincides with the spacing between the stabilizers 16 of each large terminal 12. The front ends of the large terminal locks 14*c* are connected by a connecting portion 14*d* for reinforcement. The connecting portion 14*d* connects areas of the large terminal locks 14*c* except the leading ends to be engaged with the stabilizers 16 and also is connected with the base 14*a*.

The small terminal lock 14*b* is near the rear end of the base 14*a*, whereas the large terminal locks 14*c* are near the front end of the base 14*a*. Front end of the small and large terminal locks 14*b* and 14*c* are connected directly to a slight extent. However, the small and large terminal locks 14*b* and 14*c* are displaced in forward and backward directions FBD (axial directions of the respective cavities 27, 28). The base 14*a* connects the bottom ends of the small terminal lock 14*b* and the large terminal locks 14*c* and hence functions as a reinforcement for connecting the small and large terminal locks 14*b* and 14*c*.

Projections 14*e* project sideways from opposite lateral sides of the front half of the base 14*a* and extend more forward than the base 14*a*. First and second holding arms 14*f* and 14*g* project up from the projections 14*e* for holding the retainer 14 in the housing 11. The first holding arms 14*f* are at the rear ends of the projections 14*e*, whereas the second holding arms 14*g* are near the front ends of the projections 14*e*. Locking claws are at the leading ends of the holding arms 14*f*, 14*g*.

Figure 14:
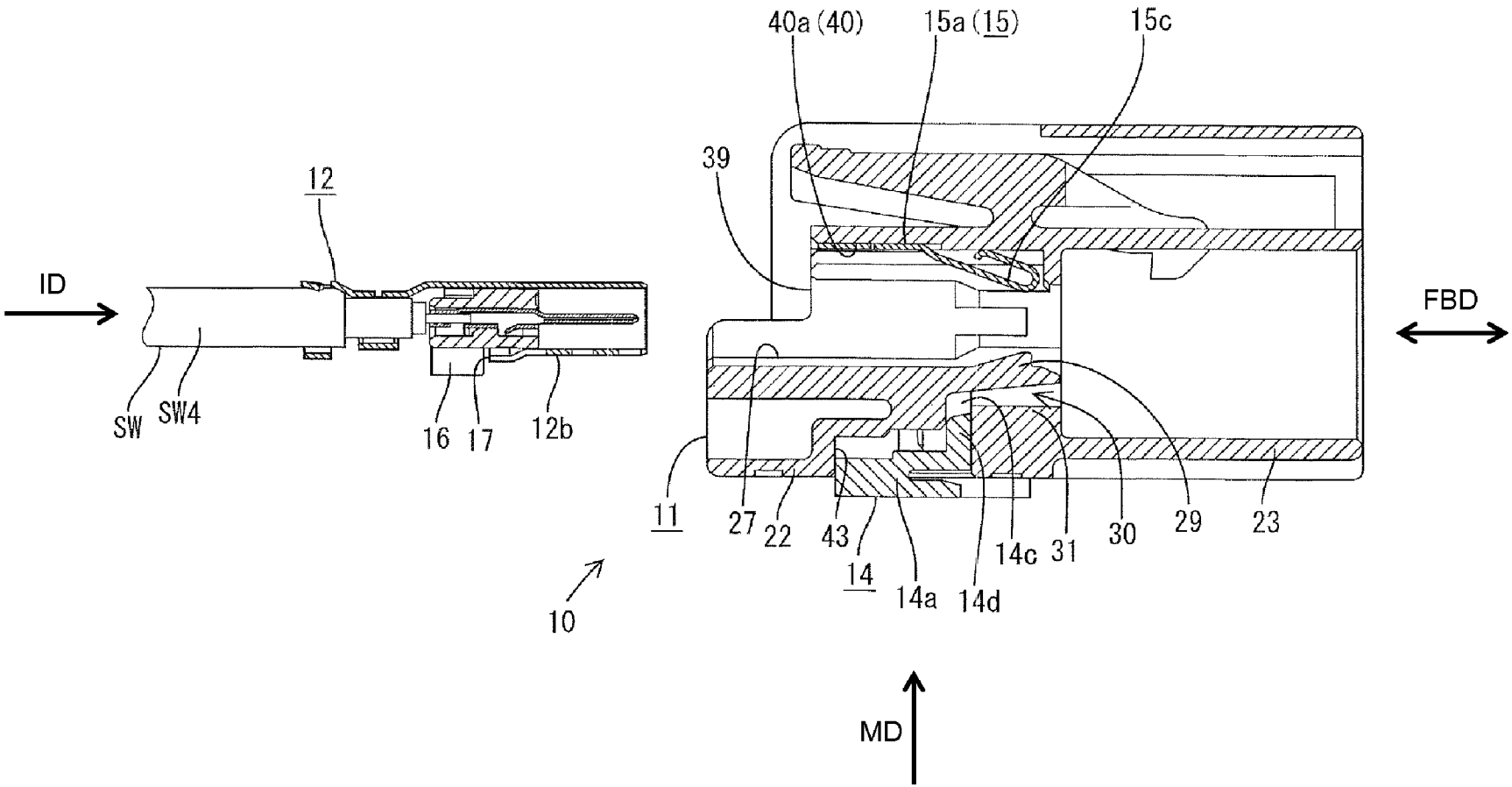
FIG. 14 is a section along A-A of FIG. 7 showing a state where the retainer is mounted at a partly locked position.
Figure 15:
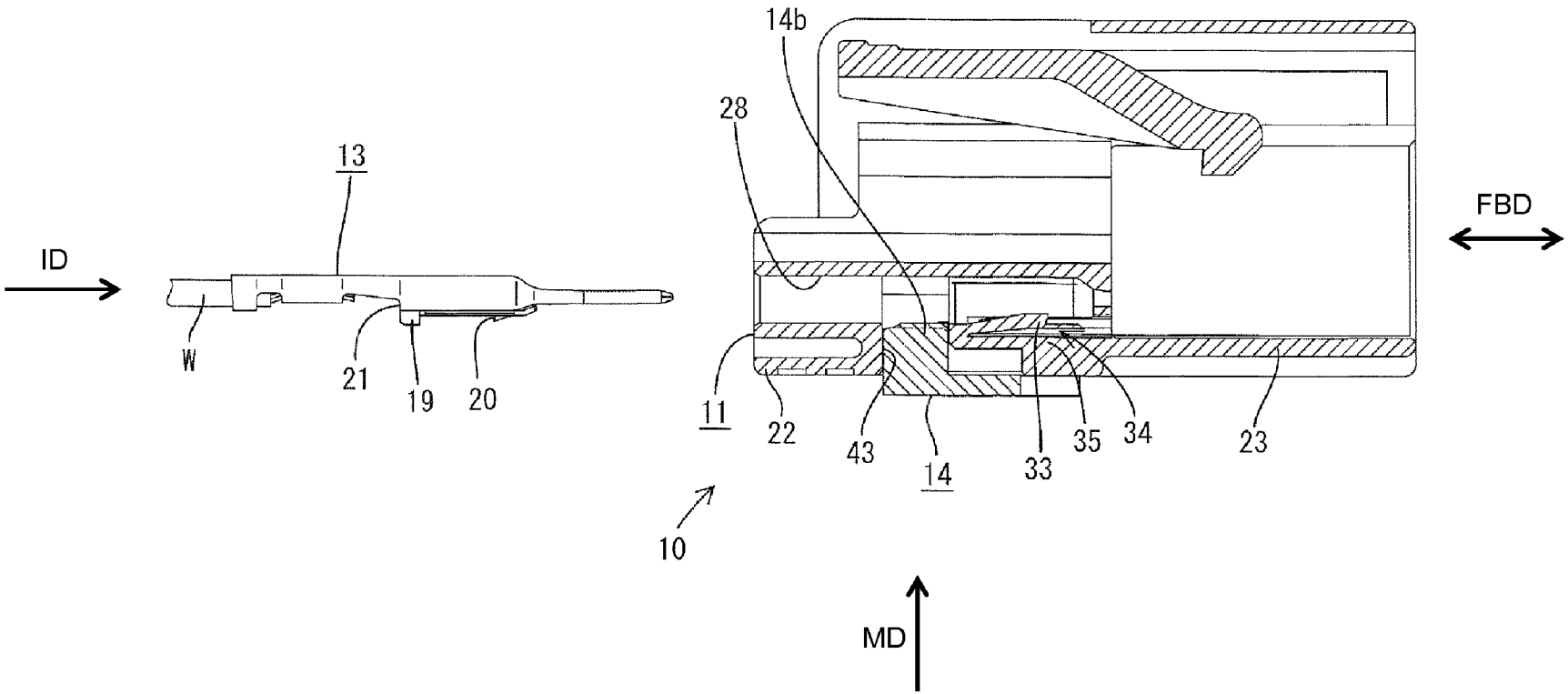
FIG.15 is a section along B-B of FIG. 7 showing the state where the retainer is mounted at the partly locked position.
Figure 16:
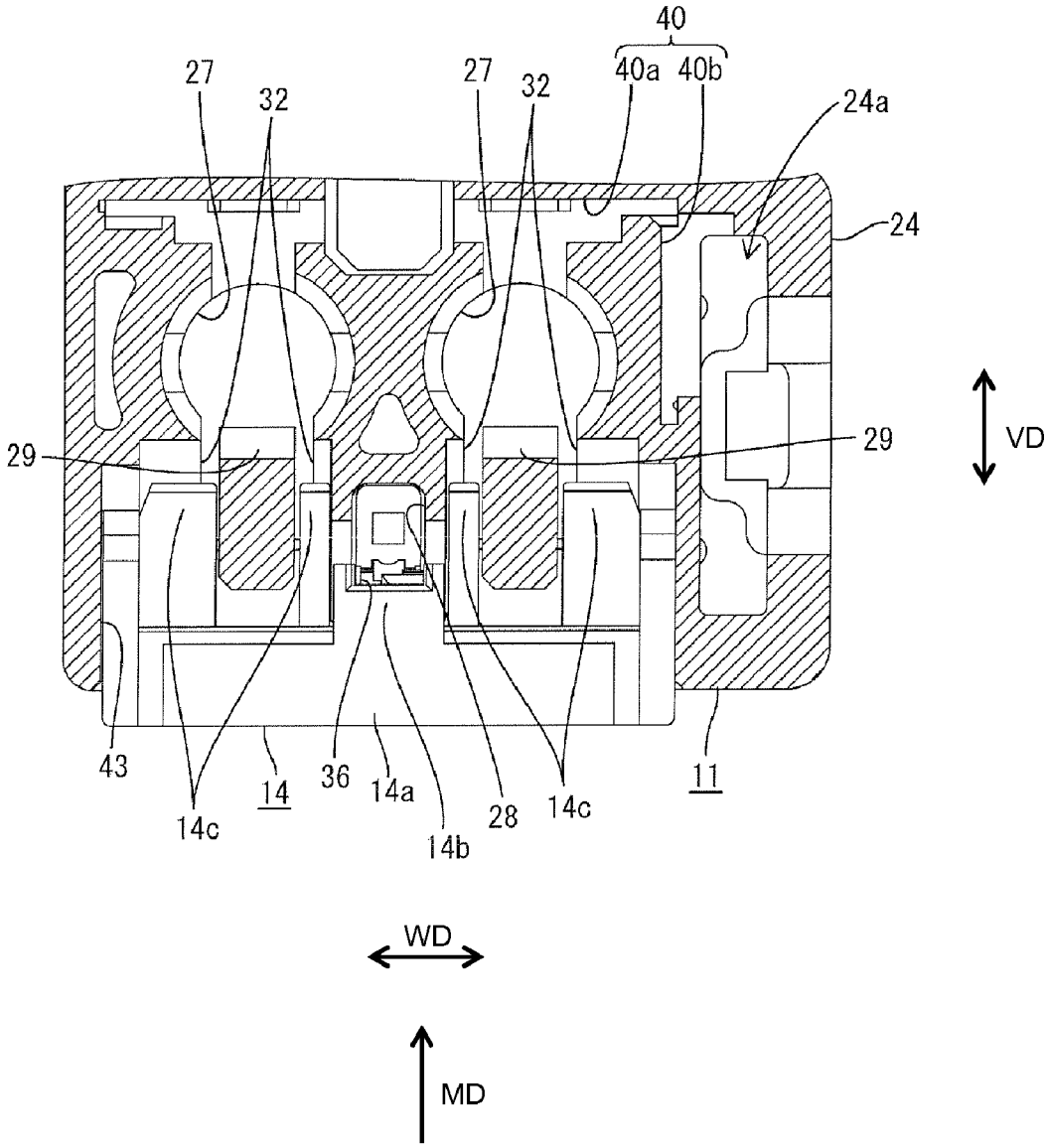
FIG. 16 is a section along C-C of FIG. 9 showing the state where the retainer is mounted at the partly locked position.
Figure 20:
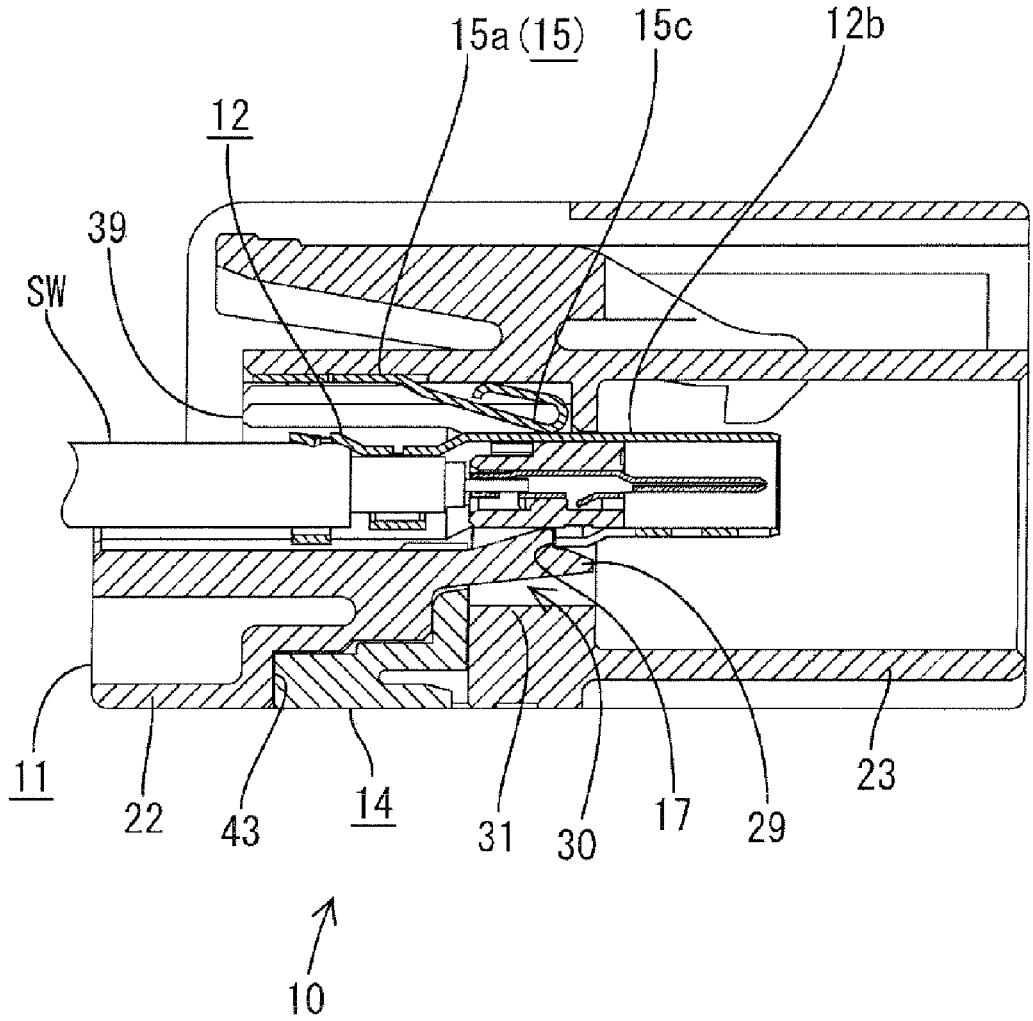
FIG. 20 is a section along A-A of FIG. 7 showing a state where the retainer is mounted at a fully locked position.
Figure 21:
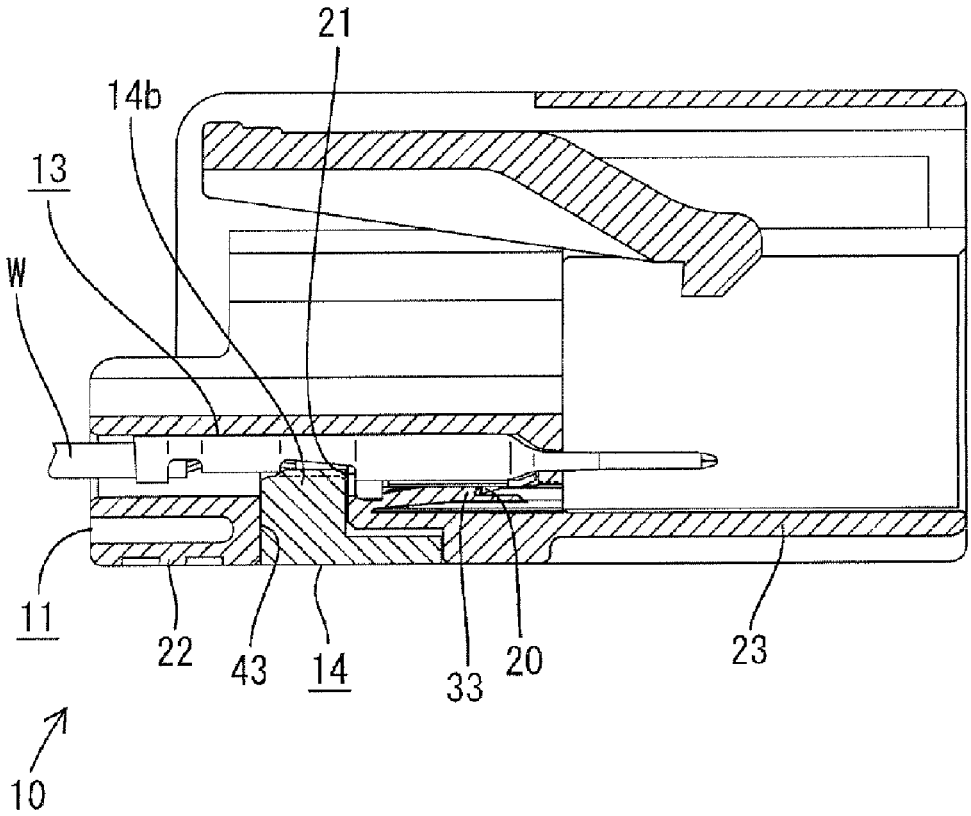
FIG. 21 is a section along B-B of FIG. 7 showing the state where the retainer is mounted at the fully locked position.
Figure 22:
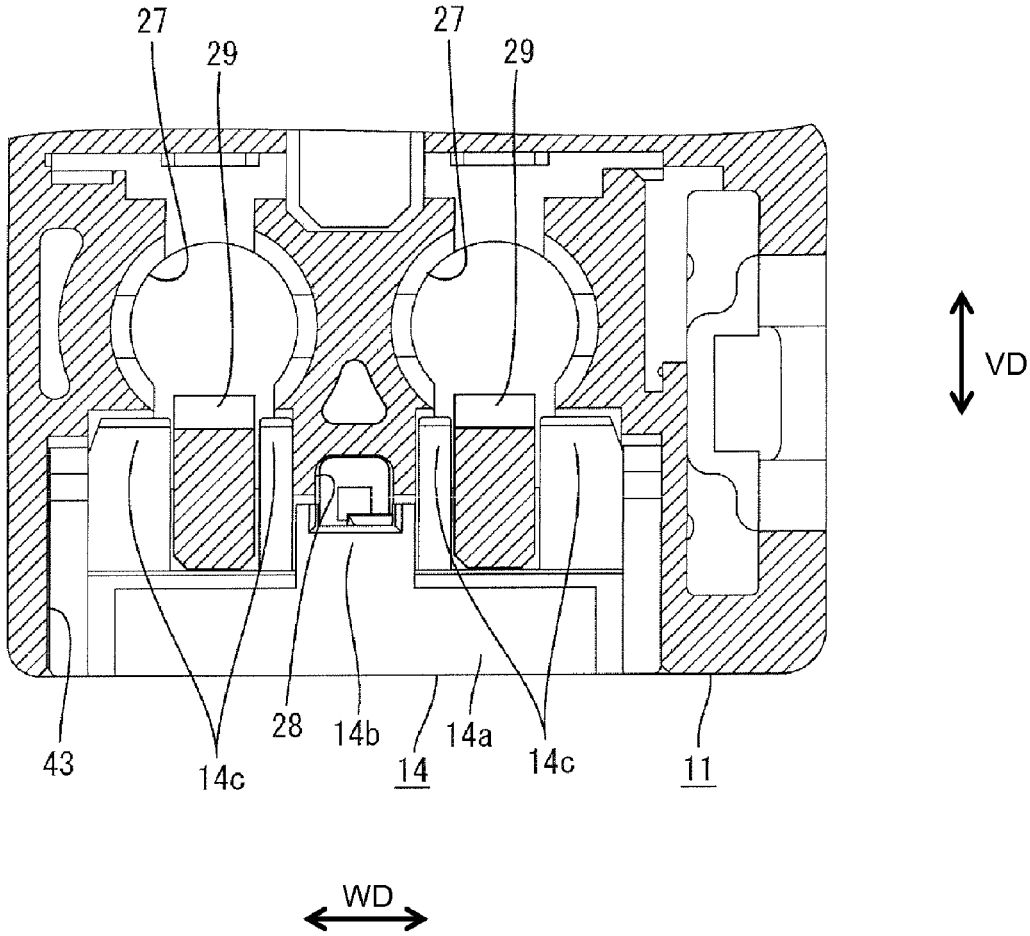
FIG. 22 is a section along C-C of FIG. 9 showing the state where the retainer is mounted at the fully locked position.
Figure 23:
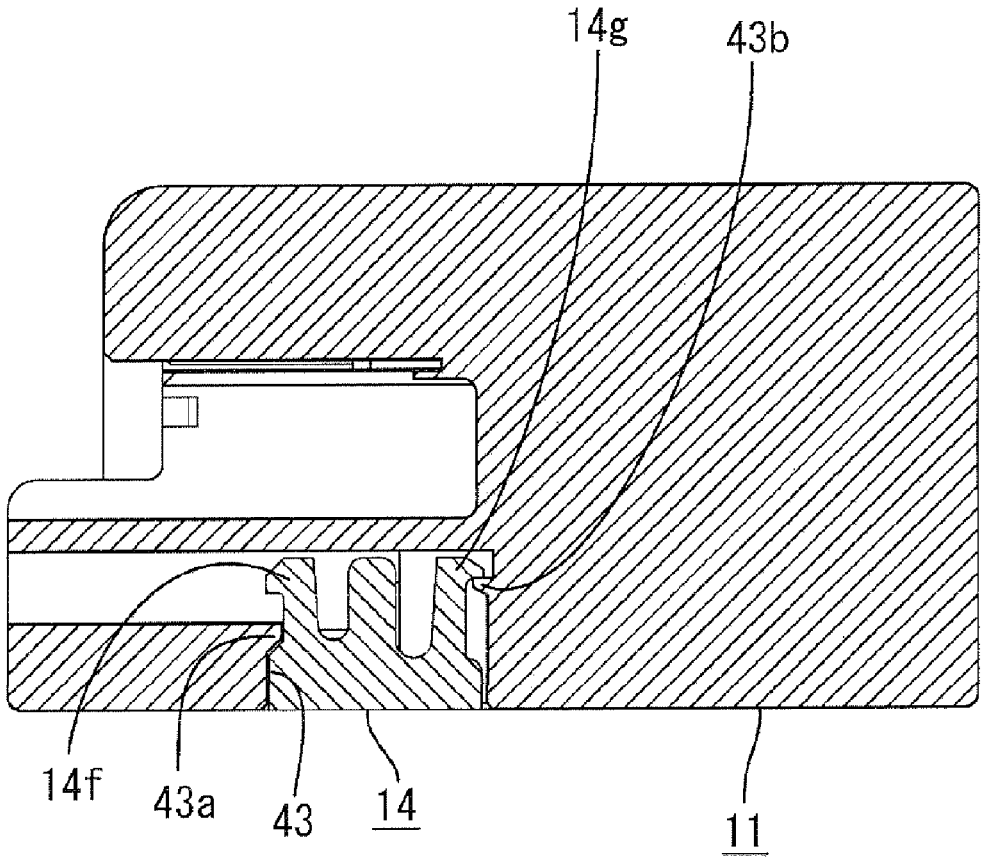
FIG. 23 is a section along D-D of FIG. 7 showing the state where the retainer is mounted at the fully locked position.

The retainer 14 can be held selectively at two vertically different positions in the housing 11. Specifically, the first holding arms 14*f* can engage the first retainer holders 43*a*, as shown in FIG. 17, to hold the retainer 14 at a partly mounted position in the retainer mount hole 43. The locks 14*b*, 14*c* are retracted down from the corresponding cavities 27, 28 when the retainer 14 is in the partly locked position, as shown in FIGS. 14 to 16, to enable insertion and withdrawal of the respective terminals 12, 13 into and from the cavities 27, 28. Additionally, the lower surface of the retainer 14 projects out from the housing 11 when the retainer 14 is in the partly locked position. On the other hand, the second holding arms 14*g* can engage the second retainer holders 43*b*, as shown in FIG. 23, to hold the retainer 14 at a fully mounted position in the retainer mount hole 43. The locks 14*b*, 14*c* enter the corresponding cavities 27, 28 when the retainer 14 is in the fully locked position to engage and retain the corresponding terminals 12, 13, as shown in FIGS. 20 to 22. The lower surface of the retainer 14 is substantially flush with the lower surface of the housing 11 when the retainer 14 is in the fully locked position.

Figure 24:
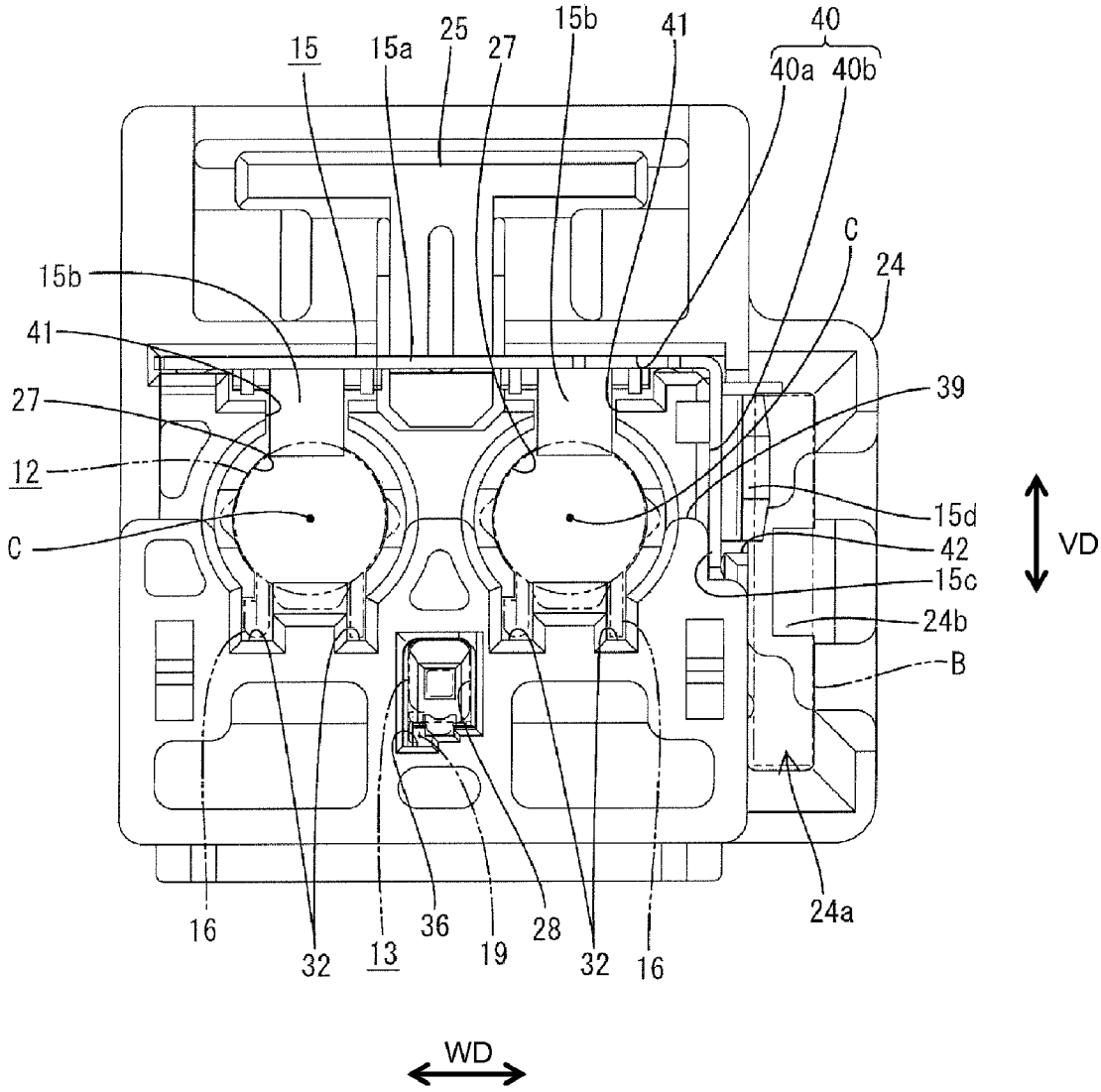
FIG. 24 is a rear view of the housing showing a state where the respective terminals and the bracket are mounted.

The retainer 14 initially is mounted at the partly locked position in the housing 11 while the ground terminal 15 is mounted into the ground terminal mounting groove 40, as shown in FIGS. 14 and 15. When the ground terminal 15 is mounted, the retaining piece bites in the peripheral edge of the ground terminal mounting groove 40 to retain the ground terminal 15, the terminal contact pieces 15*b* enter the two large cavities 27 through the terminal contact piece insertion grooves 41 and the bracket contact piece 15*d* enters the bracket accommodating chamber 24*a* through the bracket contact piece insertion groove 42 (FIG. 24).

The large terminals 12 connected with the ends of the shielded wires SW and the small terminal 13 connected with the end of the insulated wire W then are accommodated into the housing 11. More particularly, the small terminal 13 is inserted into the small cavity 28 from behind and along the inserting direction ID in a posture so that the bottom plate of the small terminal 13 faces up and the stabilizer 19 extends down, as shown in FIG. 15. Thus, the stabilizer 19 enters the stabilizer insertion groove 36 to guide the inserting operation. The stabilizer 19 cannot align with the stabilizer insertion groove 36 if the posture of the small terminal 13 is improper, and, hence, the stabilizer 19 contacts the rear end of the small cavity peripheral wall 38 to prevent insertion in a wrong posture.

Figure 19:
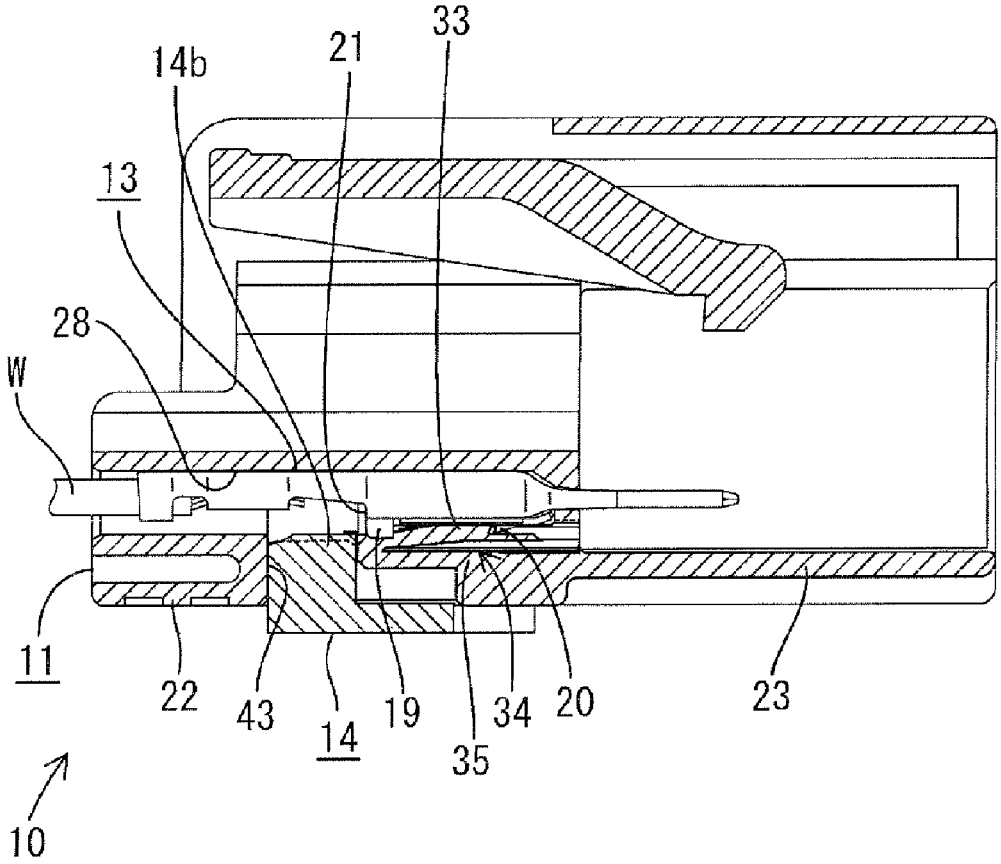
FIG. 19 is a section along B-B of FIG. 7 showing the state where the large-size terminal is inserted.

Sufficient insertion causes the small terminal 13 to deform the small-size terminal locking lance 33 temporarily into the deformation space 34. The small terminal locking lance 33 restores resiliently and engages the lance engaging portion 20, as shown in FIG. 19, when the small terminal 13 is inserted to a proper depth to achieve primary locking. At this time, the tab 13*b* of the small terminal 13 projects forward from the terminal accommodating portion 22 and into the receptacle 23.

Figure 18:
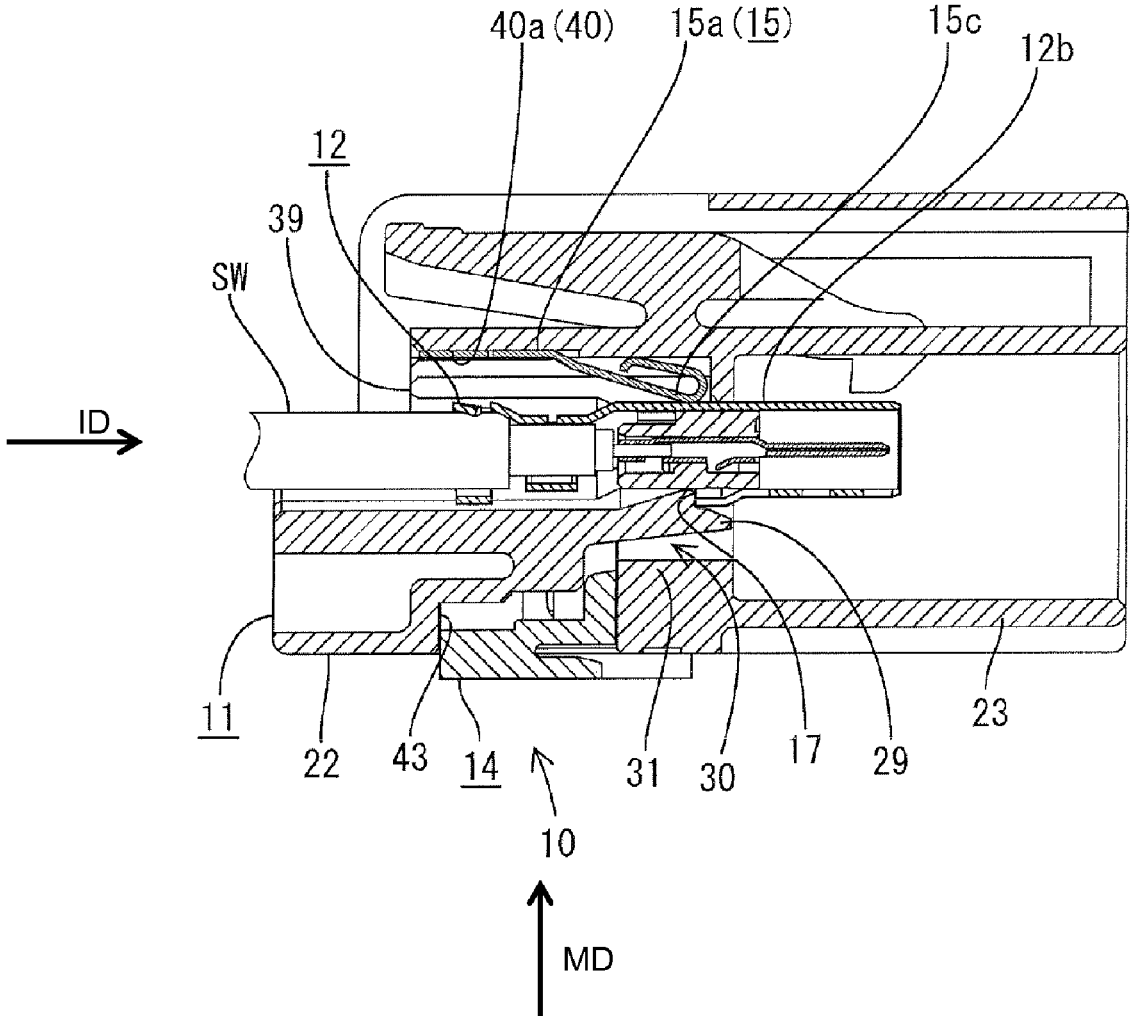
FIG. 18 is a section along A-A of FIG. 7 showing a state where the large-size terminal is inserted.

The large terminals 12 are inserted into the large cavity 27 from behind and along the inserting direction ID in a posture so that the bottom plate of the outer conductor connecting portion 13*b* of the large terminal 12 faces up and the stabilizers 16 extend down, as shown in FIG. 14. Thus, the stabilizers 16 are inserted into the corresponding stabilizer insertion grooves 32 to guide the inserting operation. The stabilizers 16 prevent erroneous insertion if the posture of the large terminal 12 is improper, as with the small terminal 13. Sufficient insertion causes the large terminal 12 to deform the large terminal locking lance 29 temporarily down and into the deformation space 30. However, the large terminal locking lance 29 restores resiliently and engages the lance engaging portion 17, as shown in FIG. 18, when the large terminal 12 is inserted to a proper depth to achieve primary locking. In this inserted state, the terminal contact piece 15*b* of the ground terminal 15 resiliently contacts the upper part of the outer conductor connecting portion 12*b* of the large terminal 12 opposite to the lance engaging portion 17. Further, the large terminal 12 is arranged so that a part of the main portion 12*b*1 more forward than the stabilizers 16 projects forward from the terminal accommodating portion 22 and into the receptacle 23.

The retainer 14 is moved from the partly locked position to the fully locked position after all of the terminals 12, 13 have been inserted into the corresponding cavities 27, 28. The first holding arms 14*f* disengage from the first retainer holding portions 43*a* when the retainer 14 is pushed up from the partly locked position shown in FIG. 17 and the retainer 14 is moved up along a mounting direction MD that is substantially normal to the inserting direction ID. The second holding arms 14*g* engage the second retainer holding portions 43*b* when the retainer 14 reaches the fully locked position shown in FIG. 23 to hold the retainer 14 at the fully locked position. At this time, the small terminal lock 14*b* is in the small cavity 28 and engages the rear end surface of the retainer engaging portion 21 of the small terminal 13, as shown in FIG. 21 to achieve secondary locking. On the other hand, the large terminal locks

14*c* are in the corresponding stabilizer insertion grooves 32 and engage the rear end surfaces of the stabilizers 16 of the large-size terminals 12, as shown in FIG. 20, to achieve secondary locking. In this way, the respective terminals 12, 13 are locked doubly and held strongly held by the corresponding locking lances 29, 33 and the retainer 14.

The connector 10 is mounted on the bracket B after the retainer 14 is moved to the fully locked position. More particularly, the bracket B is inserted into the bracket accommodating chamber 24*a* of the bracket mounting portion 24 of the housing 11 from behind and is pushed to a proper depth. Thus, the bracket locking piece 24*b* engages the lock hole Ba to retain the bracket B. At this time, the bracket contact piece 15*d* of the ground terminal 15 waiting on standby in the bracket accommodating chamber 24*a* is brought resiliently into contact with the bracket B. In this way, the outer conductors SW3, as the ground wires of the shielded wires SW, are connected electrically with the bracket B via the outer conductor connecting portions 12*b* of the large terminals 12 and the ground terminal 15 to achieve grounding.

Figure 25:
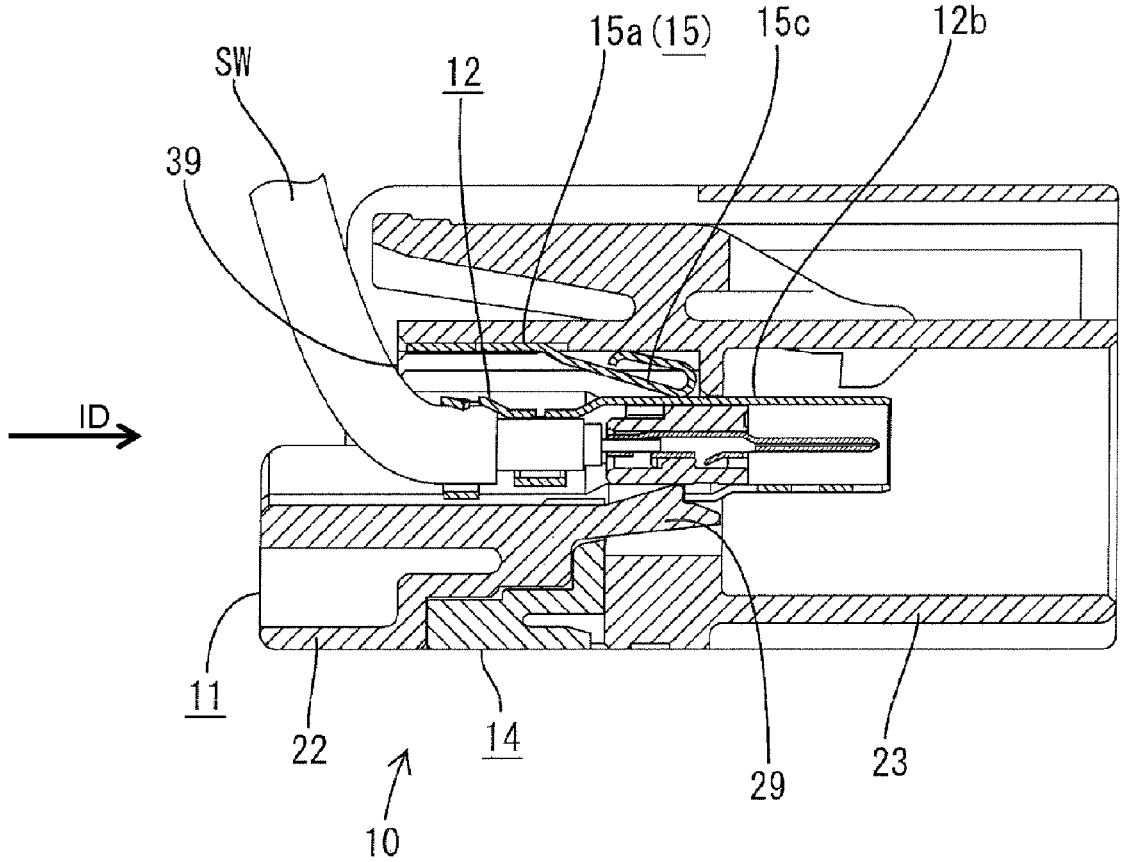
FIG. 25 is a section along A-A of FIG. 7 showing a state where a shielded wire is bent upward.

Pulling forces may be exerted on the shielded wires SW and the insulated wire W drawn out from the rear surface of the housing 11. In such a case, the shielded wire SW may be pulled up and bent toward the terminal contact piece insertion groove 41 in the large cavity peripheral wall 37. Contact of the shielded wire SW with the edge of the terminal contact piece insertion groove 41 could damage the shielded wire SW. However, the cutout 39 is formed in the upper part of the large cavity peripheral wall 37 where the terminal contact piece insertion groove 41 is formed, as shown in FIG. 25. Therefore, the shielded wire SW can escape into the cutout 39 and is unlikely to interfere with the edge of the terminal contact piece insertion groove 41.

As described above, the connector has the two or more large terminals 12 of substantially round cross sections connected with the ends of the shielded wires SW and at least one small terminal 13 connected with the end of the insulated wire W. The connector also has the housing 11 with two large cavities 27 of substantially circular cross section for receiving the large terminals 12. The large cavities 27 are arranged substantially side by side in a width direction WD. The housing 11 also has the small cavity 28 for receiving the small terminal 13. The small cavity 28 is arranged at the position between the two adjacent large cavities 27 and is displaced from the large cavities 27 in the vertical direction VD substantially orthogonal to the arrangement or width direction WD of the large cavities 27. The space between the two adjacent large cavities 27 is wider in the direction VD orthogonal to the arrangement direction WD as the space gets more distant from the center positions C of the large cavities 27 since both large cavities 27 have substantially circular cross sections. The small cavity utilizes this space so that the housing 11 can be miniaturized in the arrangement or width direction WD of the large cavities 27 as compared with the case where the respective cavities are arranged in a line. As a result, the entire connector 10 can be miniaturized.

The large terminal locking lances 29 for retaining the inserted large terminals 12 are provided at the sides of the inner surfaces of the large cavities 27 toward the small-size cavity 28 and a part of the small cavity 28 is between the two adjacent large terminal locking lances 29. Thus, part of the small-size cavity 28 utilizes the space between the two adjacent large terminal locking lances 29 even if the small-size cavity 28 cannot be accommodated completely between the two adjacent large cavities 27. This is more preferable for miniaturization as compared with the case where the large terminal locking lances 29 are arranged at the opposite sides of the inner surfaces of the large cavities 27.

The retainer 14 for retaining the respective terminals 12, 13 is mounted into the housing 11 in the mounting direction MD intersecting with the axial directions of the respective cavities 27, 28. The retainer 14 includes the large terminal locks 14*c* to be inserted into the large cavities 27 and engaged with the large terminals 12 and the small terminal lock 14*b* to be inserted into the small cavity 28 and engaged with the small terminal 13. The large terminal locks 14*c* and the small terminal lock 14*b* of the retainer 14 are displaced in the axial directions of the respective cavities 27, 28 (forward and backward directions FBD). The base 14*a* connects the large and small terminal locks 14*c* and 14*b* at their front ends with respect to the mounting direction MD into the housing 11. Therefore, the retainer 14 is strong.

The large cavity peripheral walls 37 that surround the large cavities 27 are connected to the small cavity peripheral wall 38 that surrounds the small cavity 28. A cutout 39 is formed in parts of the large cavity peripheral walls 37 at the side opposite the small cavity 28 and at the end portions where the shielded wires SW are drawn out so that the shielded wires SW can be bent at an angle to the inserting direction ID. Thus, even if the shielded wires SW can be bent without interfering with the large cavity peripheral walls 37. On the other hand, the parts of the large cavity peripheral walls 37 connected with the small cavity peripheral wall 38 remain to ensure sufficient strength for the housing 11.

A second embodiment of the invention is described with reference to FIGS. 26 to 33. In this second embodiment is shown a female connector 50 connectable with the male connector described in the above first embodiment. In the following description, reference is made to FIGS. 28 and 30 concerning a vertical direction (height direction).

Figure 30:
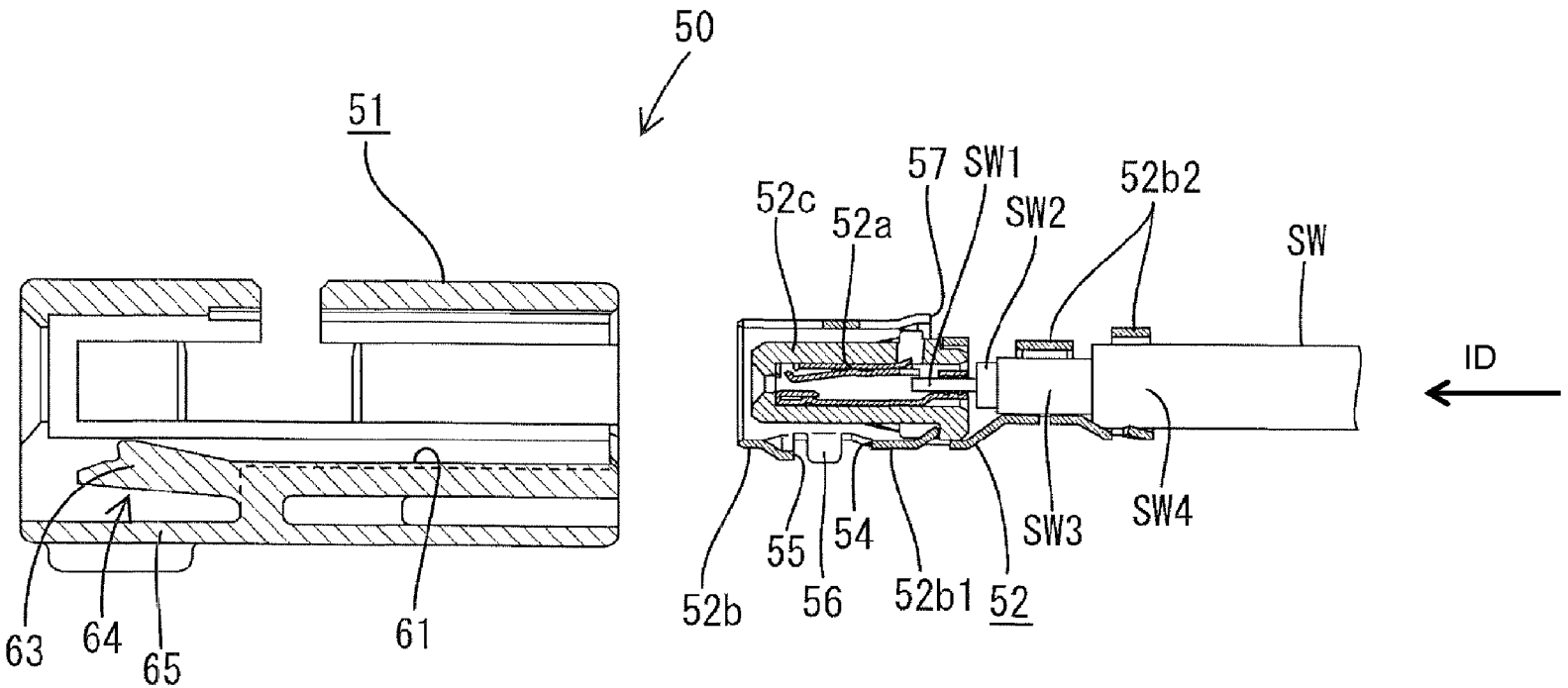
FIG. 30 is a section along E-E of FIG. 29 of the housing and the large-size terminal.
Figure 31:
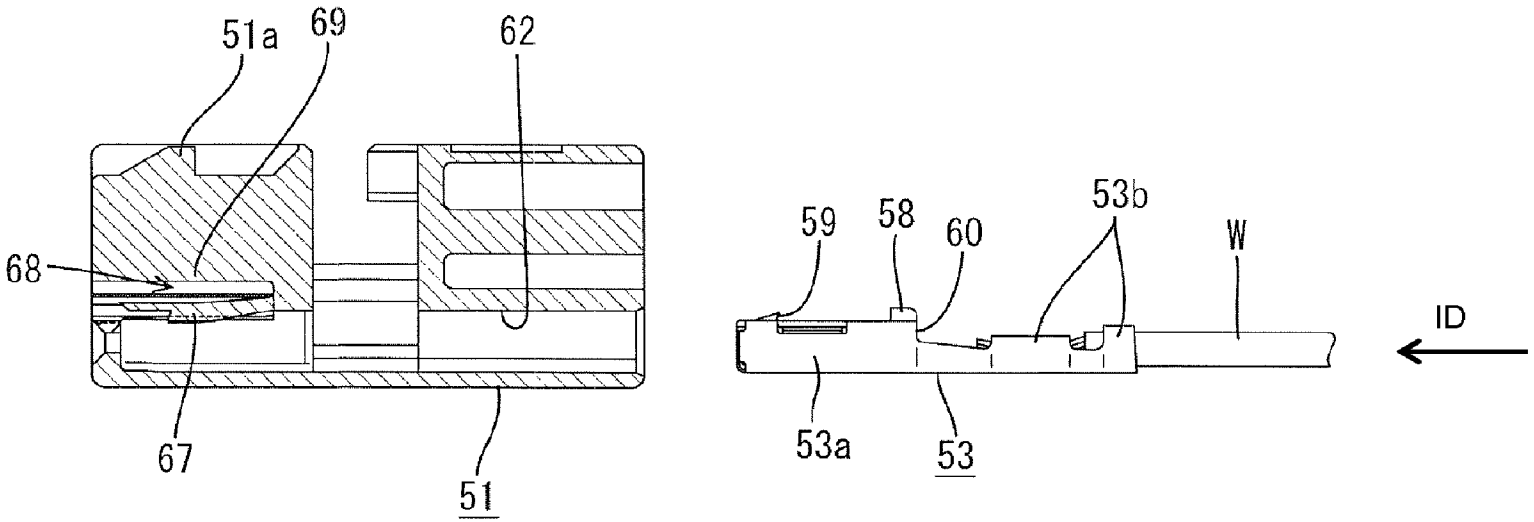
FIG. 31 is a section along F-F of FIG. 29 of the housing and the small-size terminal.

As shown in FIGS. 30 and 31, the connector 50 has a housing 51, large female terminals 52 connected with ends of shielded wires SW, at least one small female terminal 53 connected with an end of an insulated wire W and a retainer (not shown) for retaining the terminals 52, 53. In the following description, an inserting direction ID of the terminals 52, 53 into the housing 51 and an opposite pull-out direction of the wires SW, W are referred to as a forward direction and backward direction FBD. The shielded wires SW and the insulated wire W are similar to the first embodiment and are identified by the same reference numerals but are not described.

Figure 26:
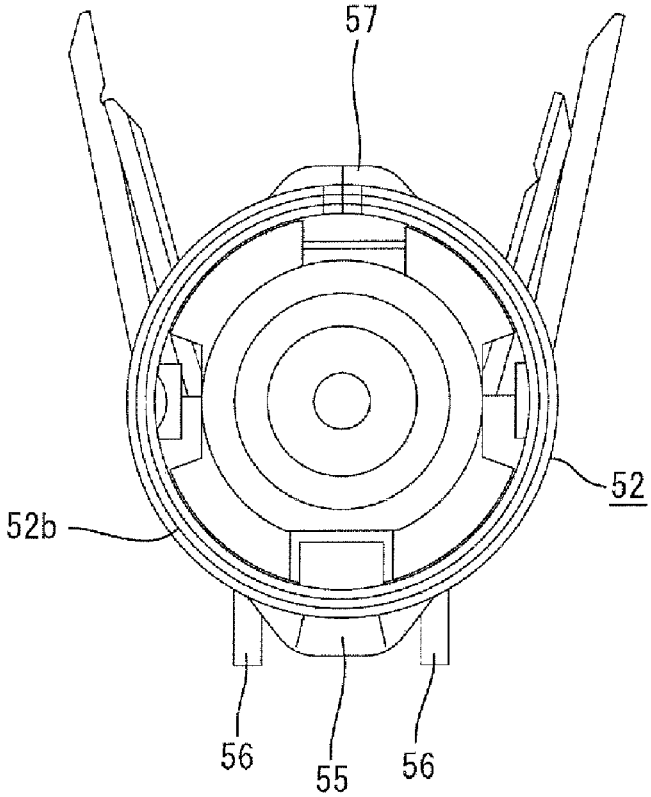
FIG. 26 is a front view of a large-size terminal according to a second embodiment of the invention.

As shown in FIG. 26, each large terminal 52 has a substantially round shape when viewed from the front and is made of an electrically conductive material, such as metal. As shown in FIG. 30, the large terminal 52 includes an inner conductor connecting portion 52*a* to be connected with an inner conductor SW1 of the shielded wire SW, an outer conductor connecting portion 52*b* outside the inner conductor connecting portion 52*a* and to be connected with an outer conductor SW3, and an insulator 52*c* between the inner and outer conductor connecting portions 52*a* and 52*b* for maintaining insulation therebetween. A space is defined between the outer conductor connecting portion 52*b* and the insulator 52*c* for permitting entry of an outer conductor connecting portion of a mating male large terminal. The outer conductor connecting portion 52*b* has a cylindrical main portion 52*b*1 surrounding the outer side of the inner conductor connecting portion 52*a* over substantially the entire periphery and a wire connecting portion 52*b*2 to be crimped, bent or folded into connection with the outer conductor SW3 exposed at the end of the shielded wire SW are connected one after the other.

An opening 54 vertically penetrates a bottom plate of the main portion 52*b*1 that is substantially continuous with the wire connecting portion 52*b*2 and permits insertion of a large terminal locking lance 63. A lance engaging portion 55 is provided near the front edge of the opening 54 and projects out from the main portion 52*b*1 for engaging the large terminal locking lance 63. Two stabilizers 56 project out and down to face each other at opposite lateral edges of the opening 54. A step-shaped retainer engaging portion 57 is provided at the rear end of a part of the main portion 52*b*1 substantially opposite to the bottom plate continuous with the wire connecting portion 52*b*2 engageable with the unillustrated retainer. The wire connecting portion 52*b*2 includes crimping pieces at front and rear sides. The inner conductor connecting portion 52*a* includes a resilient contact piece that can be brought into electrical contact with a large terminal of the mating male connector.

Figure 27:
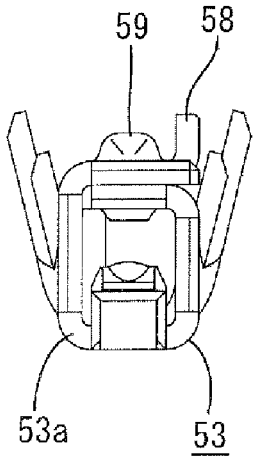
FIG. 27 is a front view of a small-size terminal.

As shown in FIG. 27, the small terminal 53 has a vertically long rectangular shape when viewed from the front and is made of an electrically conductive material, such as metal. The small terminal 53 includes a long narrow tubular main portion 53*a* that extends in forward and backward directions FBD and a wire connecting portion 53*b* extending back from the main portion 53*a*, as shown in FIG. 31.

A stabilizer 58 is provided near the rear end of an outer wall of the main portion 53*a* at an upper side substantially opposite to a bottom plate that is continuous with the wire connecting portion 53*b*. The stabilizer 58 is a plate that projects out and up in a direction substantially opposite to the projecting direction of the stabilizers 56 of the large terminals 52 from the end of the outer wall. A lance engaging portion 59 is provided at the front end of the outer wall formed with the stabilizer 58. The lance engaging portion 59 projects up in the direction substantially opposite to the projecting direction of the lance engaging portions 55 of the large terminals 52 by working the front edge of a cutout formed in an intermediate part of the outer wall. A step-shaped retainer engaging portion 60 is provided at a side of the rear end of the main portion 53*a* opposite to the bottom wall for engaging the unillustrated retainer. The wire connecting portion 53*b* has two crimping pieces at each of front and rear sides. Further, a resilient contact piece is provided in the main portion 53*a* and can electrically contact a small terminal of the mating male connector.

Figure 28:
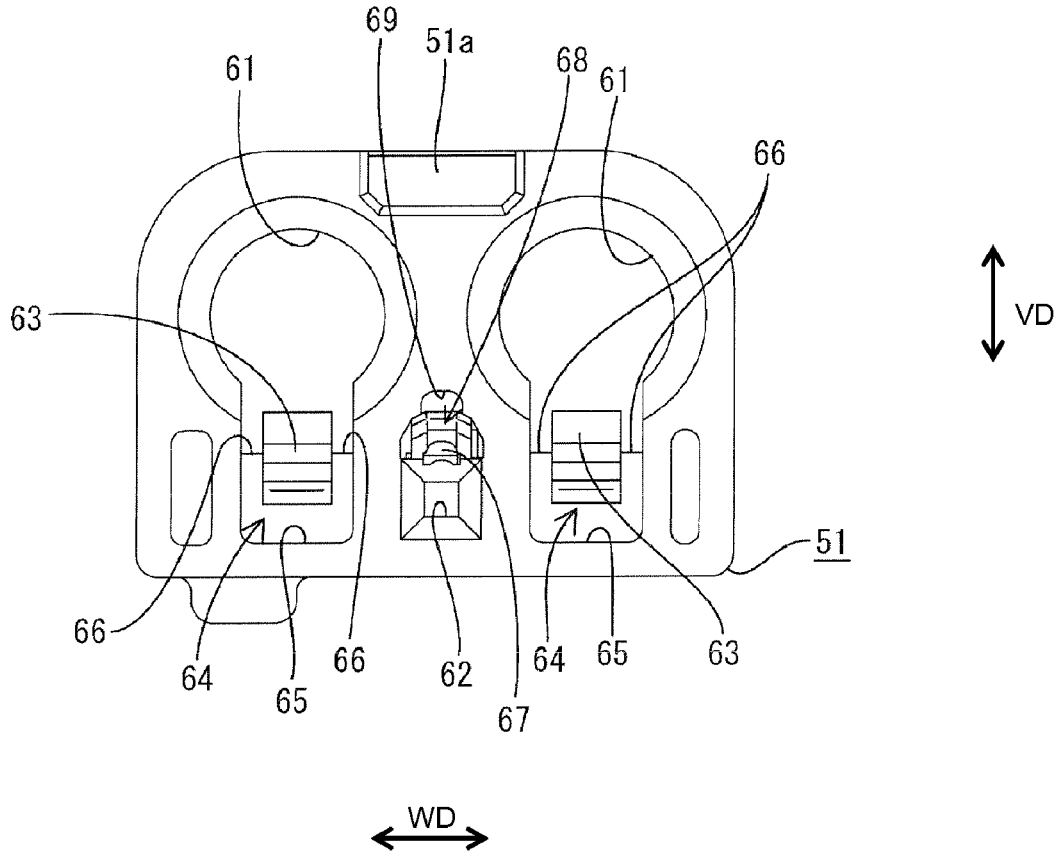
FIG. 28 is a front view of a housing.
Figure 29:
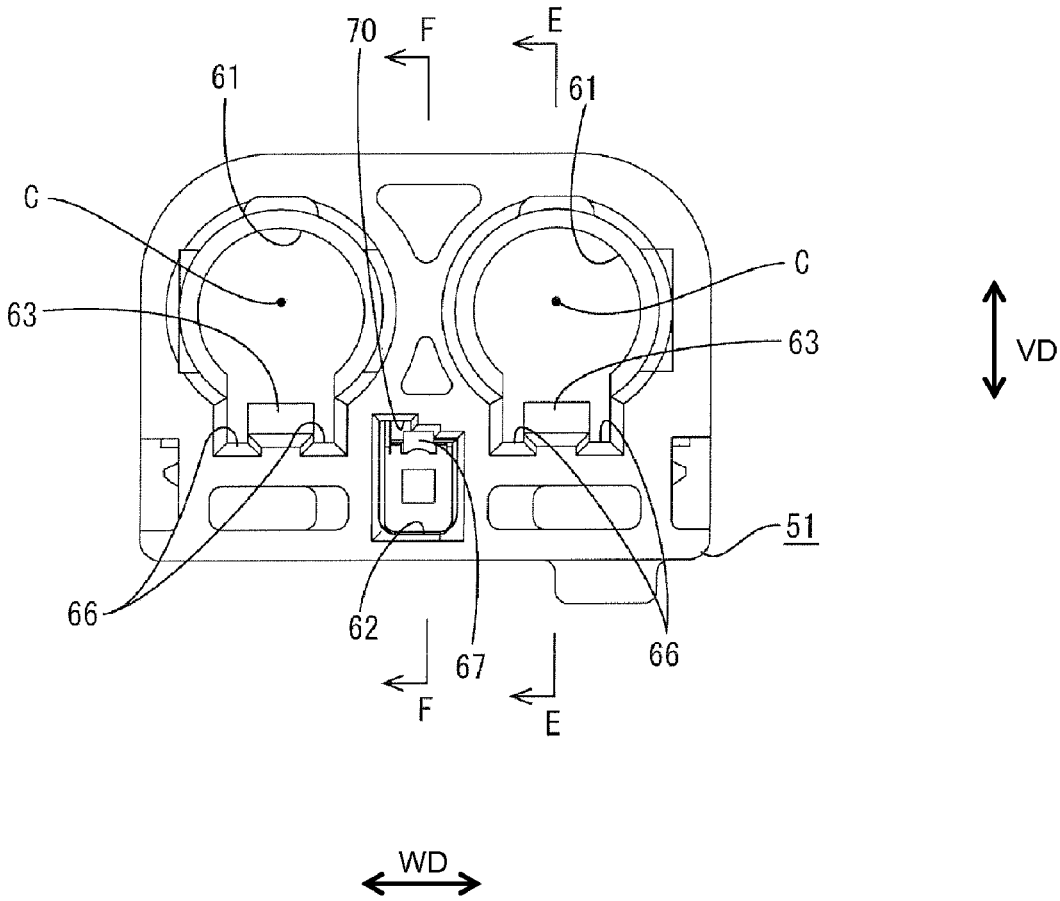
FIG. 29 is a rear view of the housing.

The housing 51 is a block made e.g. of a synthetic resin, as shown in FIGS. 28 and 29. A lock 51*a* is provided on the upper surface of the housing 11 and is engageable with a one lock arm provided on the male connector.

The housing 51 has two large cavities 61 for accommodating the large terminals 52 and a small cavity 62 for accommodating the small terminal 53. The cavities 61, 62 penetrate the housing 51 in forward and backward directions FBD, and the corresponding terminals 52, 53 are individually insertable therein from behind and along an inserting direction ID. Each large cavity 61 has a substantially round cross section that conforms to the outer shape of the large terminal 52. The small cavity 62 has a vertically long rectangular cross section that conforms to the outer shape of the small terminal 53 and the dimensions of the outer shape thereof are smaller as compared with the large cavities 61.

The two large cavities 61 are substantially side by side in the width direction WD in an upper level of the housing 51. A space between the two large cavities 61 in the width direction WD is narrowest at a position corresponding to central positions C of the large cavities 61 and is wider toward upper and lower sides from this central position due to the circular or polygonal cross section of large cavities 61. The small cavity 62 utilizes an area of the space between the large cavities 61 that is wider than an area corresponding to the central positions C. More specifically, the small cavity 62 is formed in a lower level of the housing 51 at a position between the two adjacent large cavities 61 and is displaced down in a vertical direction VD substantially orthogonal to the width direction WD of the large cavities 61 from the central positions C of the large cavities 61.

As shown in FIG. 30, a large terminal locking lance 63 is provided at a side of the inner surface of each large cavity 61 toward the small cavity 62 to engage and retain the large terminal 52. The large terminal locking lance 63 is cantilevered at a widthwise intermediate position of the large cavity 61 of the front end of the lower part of the inner surface of the large cavity 61 and is resiliently deformable down in the vertical direction VD. A deformation space 64 is defined below the large terminal locking lance 63 for permitting resilient deformation. An excessive deformation preventing portion 65 is formed below the deformation space 64 for preventing excessive deformation of the large terminal locking lance 63 by engaging the large terminal locking lance 63 before the large terminal locking lance 63 is deformed beyond its resiliency limit. The large terminal locking lance 63 is narrower than the large cavity 61. Two stabilizer insertion grooves 66 are formed at the opposite sides of the large terminal locking lance 63 in the lower part of the inner surface of each large cavity 61 for receiving stabilizers 56 of the large terminal 52. The stabilizer insertion grooves 66 form parts of the large cavity 61 and are substantially side by side in the width direction WD at opposite sides of the large terminal locking lance 63. The lower surface of the large terminal locking lance 63 is lower than lower surfaces of the stabilizer insertion grooves 66, and the deformation space 64 and the excessive deformation preventing portion 65 are even lower. The sum of the widths of the large terminal locking lance 63 and the stabilizer insertion grooves 66 is smaller than the outer diameter of the large cavity 61.

As shown in FIG. 31, a small terminal locking lance 67 is provided at an upper side of the inner surface of the small cavity 62 to engage and retain the small terminal 53. The small terminal locking lance 67 is supported at both ends and is resiliently deformable up in the vertical direction VD (direction intersecting an inserting direction ID of the small terminal 53) by cutting off the upper part of the inner surface of the small cavity 62. A lower part of the small terminal locking lance 67 including an engageable part with the small terminal 53 has a fixed width, but an upper part thereof is tapered toward the upper end (FIG. 28). A deformation space 68 for permitting a resilient deformation of the small terminal locking lance 67 is defined above the small terminal locking lance 67, and an excessive deformation preventing portion 69 is formed above the deformation space 68 for preventing excessive deformation of the small terminal locking lance 67 by engaging the small terminal locking lance 67 before the small terminal locking lance 67 is deformed beyond its resiliency limit. The small terminal locking lance 67 is narrower than the small cavity 62. A stabilizer insertion groove 70 is formed at one lateral side of the small terminal locking lance 67 in the lower part of the inner surface of the small cavity 62 for receiving the stabilizer 58. This stabilizer insertion groove 70 forms a part of the small cavity 62 and is arranged at the lateral corner of the upper surface of the small cavity 62, as shown in FIG. 29.

The small cavity 62 is arranged to overlap the stabilizer insertion grooves 66 of the large cavities 61 in the vertical direction VD. Specifically, the upper end of the small cavity 62 and the stabilizer insertion groove 70 projecting upward therefrom are in a positional relationship to be adjacent to the stabilizer insertion grooves 66 of the both large cavities 61 in the width direction WD. Further, the small terminal locking lance 67, the deformation space 68 and the excessive deformation preventing portion 69 are in a positional relationship as to be adjacent to both large cavities 61 in the width direction WD. Further, the small cavity 62 is between the inner (closer to the center of the housing 51) stabilizer insertion grooves 66 of the large cavities 61 and overlaps inner lateral ends of both large cavities 61 in the width direction WD. In this way, the small cavity 62, the small terminal locking lance 67, the deformation space 68 and the excessive deformation preventing portion 69 are arranged at positions to partly overlap the both large cavities 61 in the vertical direction VD and/or in the width direction WD and contribute to the miniaturization of the housing 51 by these overlaps. In other words, the small cavity 62 is arranged to avoid the central position where the space is narrowest between the two large cavities 61.

Further, a part of the small-size cavity 62 projecting more downward from the stabilizer insertion grooves 66 of the large-size cavities 61, i.e. a part that cannot be accommodated in the space between the two large-size cavities 61, is arranged between the two large-size terminal locking lances 63 and the two deformation spaces 64 adjacent in the width direction WD and/or is in such a positional relationship as to at least partly overlap them in the vertical direction VD. In short, the part of the small-size cavity 62 can be arranged utilizing the space between the two large-size terminal locking lances 63 and the two deformation spaces 64, which is further preferable for miniaturization.

Figure 33:
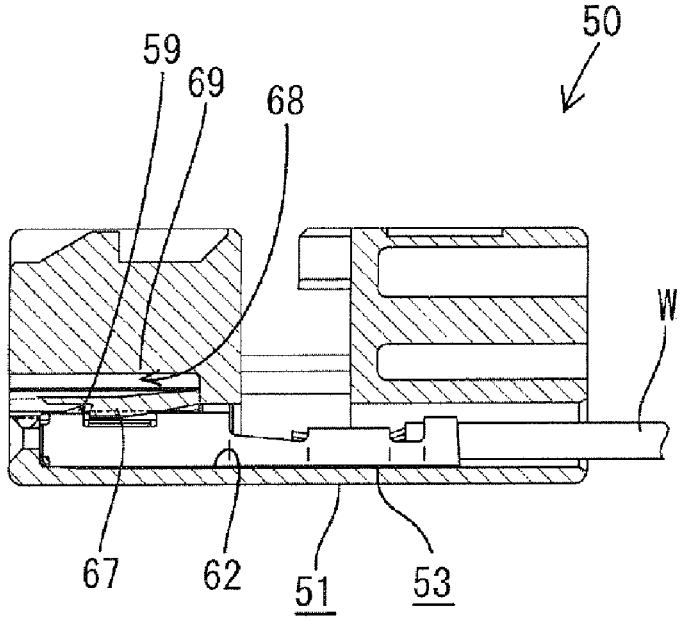
FIG. 33 is a section along F-F of FIG. 29 showing a state where the small-size terminal is inserted.
Figure 34:
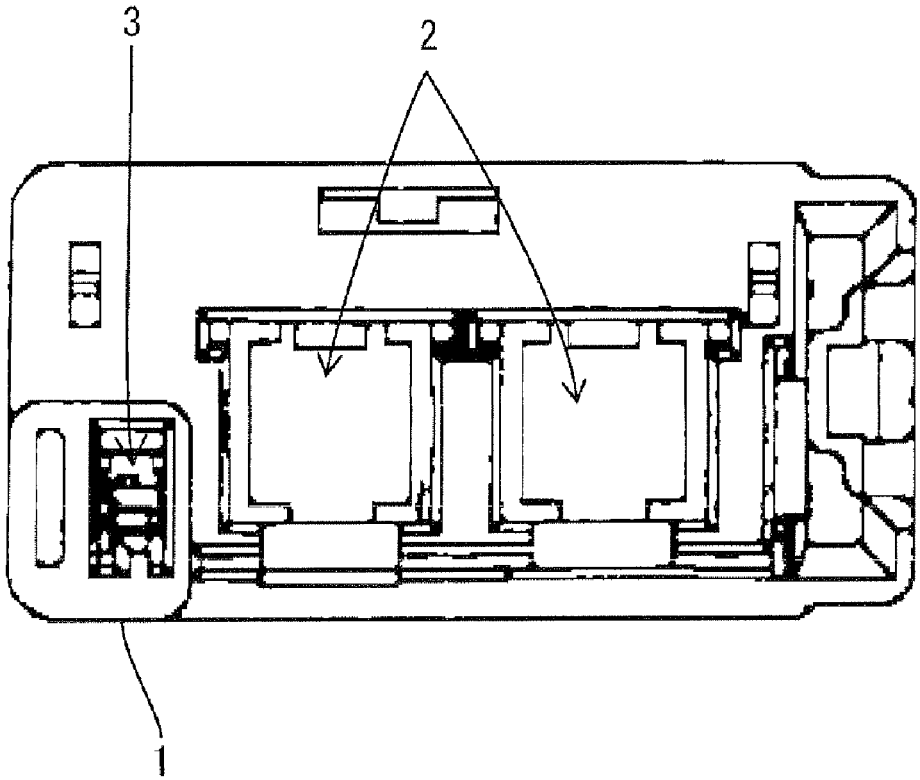
FIG. 34 PRIOR ART
FIG. 34 is a front view of a prior art housing.

The two large terminals 52 connected with the ends of the shielded wires SW and the at least one small terminal 53 connected with the end of the insulated wire W are accommodated into the housing 51. When the small terminal 53 is inserted into the small cavity 62 in the inserting direction ID from behind, in a posture so that the bottom plate of the small terminal 53 faces down and the stabilizer 58 extends up as shown in FIG. 31, the stabilizer 58 is inserted into the stabilizer insertion groove 70 to guide the inserting operation. Therefore the mounting operation proceeds smoothly. When the small terminal 53 is inserted to a specified depth in the small cavity 62, the small terminal locking lance 67 is deformed temporarily up by the small terminal 53 to enter the deformation space 68. When the small terminal 53 is inserted to a substantially proper depth, the small terminal locking lance 67 is restored and engages with the lance engaging portion 59 as shown in FIG. 33, to retain the small terminal 53.

Figure 32:
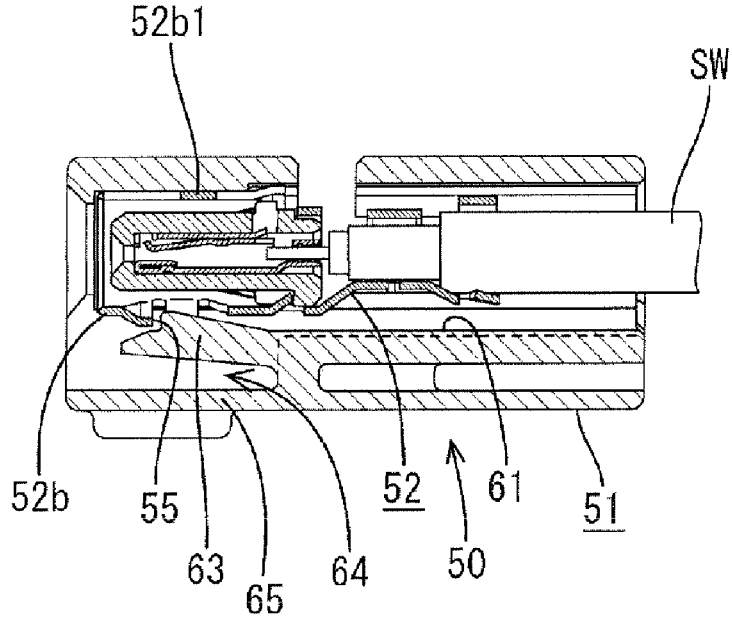
FIG. 32 is a section along E-E of FIG. 29 showing a state where the large-size terminal is inserted.

On the other hand, the large terminal 52 is inserted into the large cavity 61 from behind and along the inserting direction ID in a posture so that the bottom plate of the outer conductor connecting portion 52*b* of the large terminal 52 faces down and the both stabilizers 56 extend down as shown in FIG. 30. Thus, the stabilizers 56 enter the corresponding stabilizer insertion grooves 66 to guide the inserting operation. Therefore the mounting operation proceeds smoothly. The large terminal 52 deforms the large terminal locking lance 63 temporarily down and into the deformation space 64. However, the large terminal locking lance 63 restores resiliently and engages the lance engaging portion 55, as shown in FIG. 32, when the large terminal 52 is inserted to a substantially depth for retaining the large terminal 52.

As described above, according to this embodiment, the small terminal locking lance 67 for retaining the inserted small terminal 53 by being resiliently engaged therewith is provided at the side of the inner surface of the small cavity 62 toward the large cavities 61, and the deformation space 68 for permitting deformation of the small terminal locking lance 67 is arranged between the two adjacent large cavities 61. Thus, the deformation space 68 for the small terminal locking lance 67 utilizes the space between the two adjacent large cavities 61 for miniaturization.

The invention is not limited to the above described and illustrated embodiments. For example, the following embodiments are also embraced by the technical scope of the present invention.

Besides those shown in the above respective embodiments, the overlapping ranges of the small cavity and the two or more large cavities in the vertical direction VD and/or the width direction WD can be changed.

Although the rectangular small terminal is shown in the above embodiments, it is, of course, possible to use a round small terminal.

Although the large terminals are connected with the shielded wires in the above-described embodiments, they may be connected with normal insulated wires of the type connected with the small terminal and including neither outer conductors nor outer sheaths.

The connector with the ground terminal is shown in the first embodiment. However, the invention is also applicable to a male connector with no ground terminal. In such a case, the ground terminal mounting groove, the terminal contact piece insertion grooves and the like can be omitted from the housing. Similarly, the invention is applicable to a male connector that is not mounted on a bracket.

Two large cavities are arranged side by side in the above-described embodiments. However, three or more large cavities may be arranged side by side according to the invention. Since plural spaces are defined between the adjacent large cavities in such a case, two or more small cavities can be arranged in the respective spaces.

Although the two large cavities are arranged in the width direction in the above-described embodiments. However, they may be arranged in the vertical direction or any other arrangement direction.

The large terminal locking lances are provided at the sides of the inner surfaces of the large cavities toward the small-size cavity in the above respective embodiments. However, they may be provided at the sides of the inner surfaces of the large-size cavities opposite to the small-size cavity.

Although each large terminal locking lances is supported only at one ends in the above embodiments, they may be supported at both ends. The small terminal locking lance is not limited to the one supported at both ends and may be supported only at one end.

Although the large terminal locks are close to the front end and the small terminal lock is close to the rear end in the retainer in the first embodiment, the positional relationship of the respective locks in forward and backward directions FBD may be reversed according to the invention. Further, the present invention is also applicable to a connector with no retainer.

Although the cutout is formed in the large cavity peripheral walls of the housing in the first embodiment, it may be omitted according to the invention.

What is claimed is:

1. A connector, comprising:

at least two first terminals connected respectively with ends of first wires;

at least one second terminal connected with an end of at least one second wire and being smaller than the first terminals; and a housing with opposite first and second outer surfaces, at least two substantially side by side first cavities to have the first terminals inserted respectively therein, first terminal locking lances disposed between the respective first cavities and the first outer surface of the housing and projecting into the respective first cavities, and at least one second cavity to have the second terminal inserted therein, the second cavity being aligned at a position between the two first terminal locking lances and displaced from the two first cavities in a direction orthogonal to an arrangement direction of the first cavities.

2. The connector of claim 1, wherein the first terminals have a substantially round, elliptical or polygonal shape and the respective first cavities substantially conform to the outer shape of the first terminals.

3. The connector of claim 1, wherein the second cavity has a maximum width in the arrangement direction of the first cavities that exceed the minimum distance between the two first cavities.

4. The connector of claim 1, wherein at least one second terminal locking lance is provided at a side of an inner surface of the second cavity toward the first cavities between the second cavity and the second outer surface of the housing for engaging and retaining the inserted second terminal.

5. The connector of claim 4, wherein a deformation space is arranged at least partly between the two first cavities for permitting a resilient deformation of the second terminal locking lance.

6. The connector of claim 1, further comprising stabilizer insertion grooves formed in each first cavity at the sides of the first terminal locking lance for receiving stabilizers of the first terminal.

7. The connector of claim 6, wherein the second cavity is arranged to at least partly overlap the stabilizer insertion grooves of the adjacent first cavities in the displacement direction.

8. The connector of claim 7, wherein a sum of a width of the first terminal locking lance and widths of both stabilizer insertion grooves is less than a diameter of the first cavity.

9. The connector of claim 1, further comprising a retainer mounted into the housing in a direction intersecting axial directions of the cavities and intersecting the arrangement direction of the first cavities, the retainer including first terminal locks for entering the first cavities to engage and retain the first terminals therein and at least one second terminal lock for entering the second cavity to engage and retain the second terminal.

10. The connector of claim 9, wherein the first terminal locking portions and the second terminal locking portion are displaced in the retainer in axial directions of the respective cavities.

11. The connector of claim 10, wherein front ends of the terminal locks with respect to a mounting direction of the retainer into the housing are connected by a reinforcement.

12. The connector of claim 1, wherein:

first cavity peripheral walls surrounding the first cavities and a second cavity peripheral wall surrounding the second cavity are connected with each other in the housing, and at least one cutout is formed in parts of the first cavity peripheral walls at a side substantially opposite to the second cavity and at end portions where the wires are drawn out for permitting the wires to be bent.

13. The connector of claim 12, wherein each wire connected with the first terminal is a shielded wire with an outer conductor substantially concentrically outside an inner conductor, and each first terminal includes an outer conductor connecting portion to be connected with the outer conductor of the shielded wire.

14. The connector of claim 13, further comprising a ground terminal mountable to the housing and including terminal contact pieces disposed for electrical contact with the outer conductor connecting portions, and terminal contact piece insertion grooves formed in parts of the first cavity peripheral walls substantially opposite to the second cavity for permitting entry of the terminal contact pieces into the first cavities.

15. The connector of claim 1, wherein at least one bracket mounting portion is on a side surface of the housing for receiving a bracket fixed to an outside body.

* * * * *